US006990914B2

(12) United States Patent
Canan

(10) Patent No.: US 6,990,914 B2
(45) Date of Patent: Jan. 31, 2006

(54) MOVABLE QUILTING WORK AREA SYSTEM AND METHOD

(75) Inventor: Timothy G. Canan, Port Townsend, WA (US)

(73) Assignee: McMuffin & Snuffles, Inc., Port Townsend, WA (US)

( * ) Notice: Subject to any disclaimer, the term of this patent is extended or adjusted under 35 U.S.C. 154(b) by 19 days.

(21) Appl. No.: 10/925,389

(22) Filed: Aug. 25, 2004

(65) Prior Publication Data

US 2005/0045083 A1 Mar. 3, 2005

Related U.S. Application Data

(60) Provisional application No. 60/497,812, filed on Aug. 25, 2003.

(51) Int. Cl.
*D05B 11/00* (2006.01)

(52) U.S. Cl. ..... 112/119

(58) Field of Classification Search ..... 112/117–119, 112/402, 470.03, 470.12, 470.13

See application file for complete search history.

(56) References Cited

U.S. PATENT DOCUMENTS

| | | | | |
|---|---|---|---|---|
| 4,192,241 | A | 3/1980 | Reed et al. | |
| 6,615,756 | B2 * | 9/2003 | Barrus | 112/119 |
| 6,792,884 | B1 * | 9/2004 | Barrus | 112/475.08 |
| 2003/0079666 | A1 | 5/2003 | Barrus | |
| 2003/0200906 | A1 * | 10/2003 | Maag | 112/117 |

* cited by examiner

*Primary Examiner*—John J. Calvert
*Assistant Examiner*—Brian Kauffman
(74) *Attorney, Agent, or Firm*—Innovation Law Group, Ltd.; Jacques M. Dulin, Esq.

(57) ABSTRACT

An improved quilting apparatus and method for automatically providing a variable sewing area (VSA) independent of the throat depth of the sewing machine used and X/Y carriages on which the sewing machine is mounted, comprising a rotatably-powered take-up roller mounted on laterally movable carriages, a tension system for continuous tension on fabric and batting, arm-mounted or sewing machine-mounted sensors that detect proximity or engage fabric on the take-up roller and cause rotation of the take-up roller so that it is out of the way of the advancing or returning sewing machine. The inventive VSA system includes a microprocessor-based controller for automatic operation, which controller interfaces with PC operated quilting programs that drive powered X/Y carriage systems to allow sewing of quilting patterns much larger than the throat depth of conventional sewing machines.

20 Claims, 15 Drawing Sheets

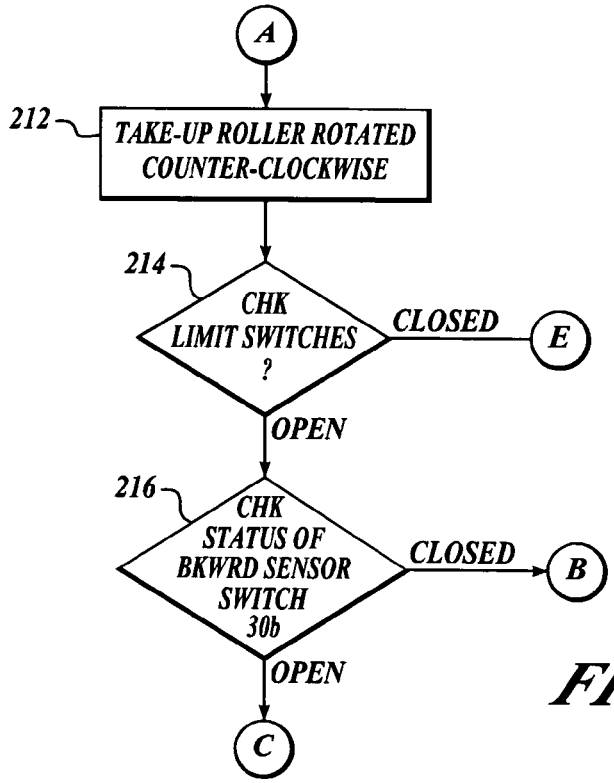
FIG. 10B
FIG. 10C
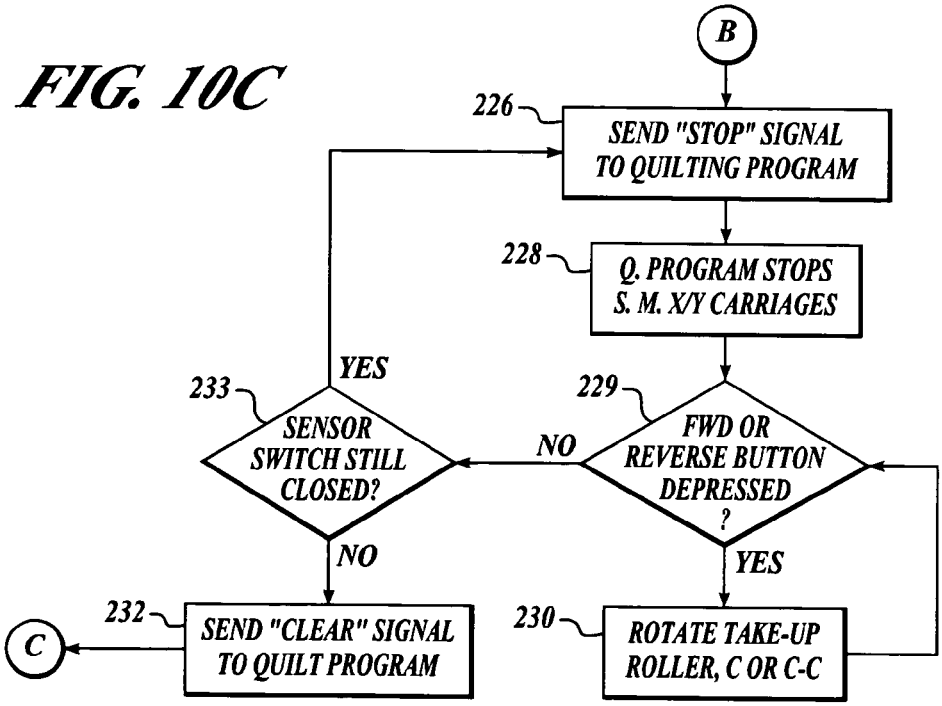

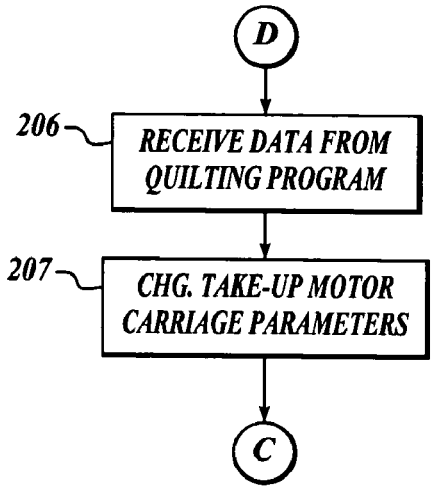
FIG. 10D
FIG. 10E
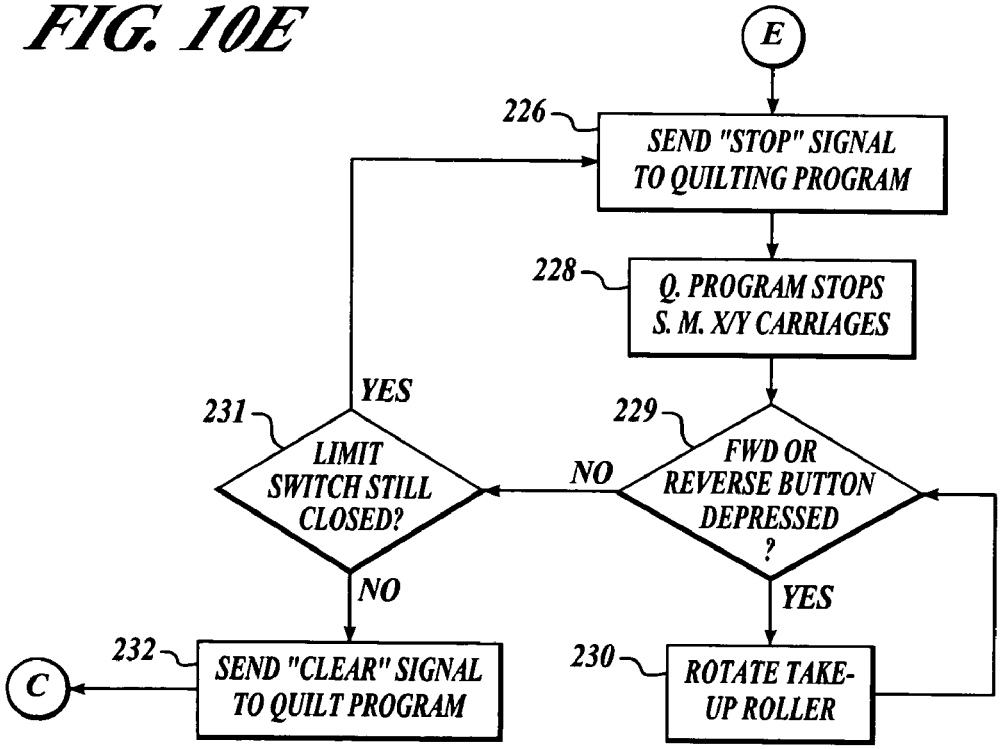

MOVABLE QUILTING WORK AREA SYSTEM AND METHOD

CROSS REFERENCE TO RELATED APPLICATIONS

This application is the Regular U.S. Application of prior Provisional Application Ser. No. 60/497,812 filed Aug. 25, 2003 under the same title by the same inventor, the filing date of which is claimed for priority under 35 U.S. Code § 120.

FIELD

This invention relates to quilting devices, and more particularly, to apparatus and methods for quilting and sewing patterns of a larger size than would otherwise be possible using a commercially available consumer sewing machine with a limited throat depth in association with a conventional quilting frame, characterized by a moveable, powered take-up roller maintained under constant tension and controlled by a sensor system to provide a movable work area that permits sewing quilting patterns laterally larger than the throat depth of the sewing machine used.

BACKGROUND

Quilting has been practiced for several centuries throughout the world. Quilts were originally used as bed covers for warmth. Currently, most quilting is performed by hobbyists and smaller businesses and is oriented broadly towards arts and craft, including artistic decoration and historic and commemorative patterns. Originally, quilting was done by hand stitching of patterns, or different pieces of fabric to form patterns, on the fabric layers for purposes of ornamentation and to bind the fabric and internal batting layers together. As the making of quilts has become more hobby oriented, hand stitching has become less common because of the lack of time by hobbyists. Hobbyists and small companies also desire to make larger quilts to accommodate modern queen and king sized beds and to make a larger number of quilts in the same time as previously needed to make a quilt using hand sewing methods.

Designs or patterns are sewn into portions of a quilt by hand, by using a hand guided sewing machine, by using a template-guided sewing machine, or by using a computer guided sewing machine. Several decades ago, large professional quilting frames became commercially available and included sewing machines having a throat depth on the order of 24 inches. The throat depth of a sewing machine restricts the size of a pattern that can be sewn when used with a quilting frame. Such professional quilting frames were, and still are, very expensive and require a considerable amount of space to set up and use. In recent years, lightweight, less expensive, hobby-oriented quilting frames or frame kits for use with a home sewing machine or for use with a smaller version of professional sewing machines have become common.

Home sewing machines, however, have very limited throat depth—on the order of 6–9 inches. Thus, both hobby quilting frames and professional quilting frames are restricted to sewing patterns having a lateral dimension no larger than the throat depth of the sewing machine, less the amount of space occupied by the take-up roller (including the fabric layers and batting rolled onto the take-up roller). This restriction occurs because the take-up roller is fixed in relationship to the payout rollers in order to maintain fabric tension. The take-up roller is located within the throat of the sewing machine and takes up the quilted material typically consisting of fabric layers and internal batting. Accordingly, the lateral "working pattern depth" motion of the sewing machine needle is restricted to the depth of the exposed material within the depth of the sewing machine throat. As the take-up roller gets larger with the accumulated completed quilt, this "working depth" gets smaller and smaller. The result is that patterns must be completed in ever-narrowing longitudinal strips—some as small as 4 inches. This is a major problem for, and complaint of, owners of present hobby quilting frames. This limited working depth problem has caused many potential buyers of hobby quilting frames to not purchase such a product.

Some manufacturers of professional quilting frames have added motors with controlling electronics to the fixed payout and/or fixed take-up rollers. However, motorizing fixed rollers does not allow for sewing larger patterns because the working depth and area is still restricted by a combination of the fixed spatial relationship of the rollers and the throat depth of the sewing machine. As a result, motorized roller systems are used to automatically create quilts with only very simplistic patterns by sewing in an area limited to the throat depth of the sewing machine, automatically advancing the quilt to expose a new working depth (a new "strip"), then sewing the next area (strip), and so on. Such roller motors simply advance the fabric layers in working depth increments through the quilting frame. In addition, roller motors and associated control electronics of automated commercial machines are expensive and are normally used only for production of simplistic patterned quilts. They are not available for, and do not address, the needs of the hobby-quilt artist, particularly in cases of large, complex or intricate artistic patterns.

Although professional quilting machines use sewing machines with deeper throats, up to 30 inches, the payout and take-up rollers are of a fixed nature and thus only permit sewing patterns limited by that throat depth. Likewise, the payout and take-up rollers of conventional hobby quilting frames are fixed, and the throat depth is even smaller by virtue of use of smaller and less expensive sewing machines.

Accordingly, there is a need in the art to provide an apparatus and method for quilting that allows sewing of larger patterns independent of the limitations of the sewing machine throat depth that is simple, inexpensive and automatic, that is applicable to free hand, computer controlled X-Y carriage and template-guided pattern sewing for a wide range of hobby arts and craft quilting that permits the sewing of full pattern depth, whether 6", 8", 12", 16", 24" or more in depth, the full longitudinal width of the quilt, rather than decreasing strips of partial patterns, eliminating pattern registration errors, and which effectively provides a larger than normal pattern area for automatic pattern sewing with home-type non-commercial sewing machines.

THE INVENTION

Summary of the Invention, Including Objects and Advantages

The invention comprises a system, apparatus and method that provides a powered, moveable take-up roller assembly for a quilting frame under uniform constant tension, independent of sewing machine type used, sewing machine throat depth, type of patterning control, sewing machine pattern motion carriage system and type of quilting frame, that provides a movable (floating) work area, called a variable sewing area (VSA). The invention is termed herein "the inventive VSA system".

By way of example, a quilting frame used in the inventive system may have a total working depth between the fabric supply and take-up rollers of 18–26". By the use of the inventive powered movable take-up roller assembly, a quilter can sew a 24"+ pattern depth the full width of the quilt with a consumer or hobby sewing machine having only a 6" throat.

The quilting frame is mounted on a work surface, such as a table on the order of 3' deep by 6'–12' long. The table depth is defined as the Front to Back, or "lateral" dimension of the frame and comprises the Y axis of motion of the sewing machine on its pattern motion carriage assembly. The table length is defined as the Left to Right "longitudinal" dimension of the table and comprises the X axis of motion of the sewing machine on its pattern motion carriage assembly. As used throughout, the motion orientation is considered from the perspective of a quilter using the quilting frame and standing approximately midway between the longitudinal ends, facing the frame and sewing machine on its X/Y pattern motion carriage assembly. The direction away from the quilter, that is from the take-up roller toward the pay-out roller is considered "Forward", and the return is considered "Back". The motion to the quilter's left is called "Left" and the motion to the right is Right".

The orientation of the parts is generally consistent, although perhaps counter-intuitive, in that the parts closest to the quilter are called "Back" or "Rear" parts, e.g., the rear roller which is the take-up roller, whereas the "Front" parts are those laterally farthest from the quilter, e.g, the pay-out rollers are the front rollers. Thus, Forward/Backward refer to motion and Front/Rear or Front/Back refer to position, all relative to the operator (quilter) position.

However, the sensors are identified with respect to the direction of motion of the sewing machine, so that the sensor closes to the operator is identified as the Forward motion sensor, $S_F$, as it activates as the sewing machines moves Forward. Conversely, the sensor adjacent the needle is the Backward motion sensor, $S_B$.

The sewing machine is preferably mounted on a powered X–Y pattern motion carriage apparatus, which in a preferred embodiment comprises a pattern motion carriage base platform (the X-motion platform) that rolls in the longitudinal X axis on a pair of longitudinal tracks mounted on the framework table between the opposed, spaced end supports. The pattern motion carriage base X-motion platform includes top surface-mounted tracks on which a motion carriage upper platform rolls Forward/Back in the Y axis (the Y-motion platform). The sewing machine rests on the upper, Y-motion platform. Together the sewing machine is provided a full range of X/Y pattern motion the full width of the quilting frame. Electronics of the X/Y motion carriage apparatus includes a stepper motor driver that actuates both X-axis and Y-axis motors that in turn engage toothed X and Y timing belts secured to the X carriage (for the Y motion) and to the longitudinal track or table (for the X-motion), respectively, or equivalent for precise positioning of the sewing machine in accord with continuously changing X,Y coordinates of patterns.

A computer, typically a personal computer (PC), is employed to provide data to the microprocessor(s) to drive both the X/Y motion carriage apparatus and the inventive movable takeup roller carriages. A quilting applications program that includes a number of user-selectable patterns is loaded on the PC. It translates the pattern into X/Y and stitch data, provides motor parameters for the take-up roller motors, and receives stop or clear signals from the limit switches and the roller position sensors on the sewing machine, sensing arm or sensing wire. A number of quilting programs and powered X/Y carriage systems are commercially available. In the present best mode, it is preferred to use a "PC Quilter" brand motorized X/Y carriage and software system commercially available from Quilting Technologies of Port Townsend, Wash.

The inventive VSA system comprises a powered take-up roller journaled on opposed ends in take-up roller carriage plates that are laterally moveable (parallel to the Y axis) on/in opposed end supports, and a tension system that provides a continuous tension on the fabric as it is being sewn. The carriage plates may be mounted, by way of example, on rollers or slide members engaging tracks in or on the end supports. In the preferred embodiment, each carriage plate is motorized so that the take up roller stays orthogonally true to the end supports and the take-up and fabric/batting supply rollers to eliminate binding. Preferably the motors are DC motors so that they provide synchronous motion of the spaced, opposed take-up roller carriages.

Each motor is, by way of a first example, activated by contact sensors (take-up roller position sensors), $S_F$ and $S_B$, that are mounted on the sewing machine at each end of the throat. In a second embodiment the roller position sensors are mounted on an arm which is, in turn, mounted on the Y carriage. The sensors, by way of preferred example, engage the fabric and batting rolled-up on the take-up roller. The sensors are spaced apart essentially equal to or fractionally less than the normal throat depth, T, of whatever sewing machine is employed.

It should be understood that the X/Y carriages need not be powered, in which embodiment the sewing is essentially free-hand in the X/Y directions, but the inventive VSA system can be used with benefits identical to the case for powered X/Y carriages. In the free-hand embodiment, the Y carriage may comprise a sewing machine with wheels on its base allowing for the necessary lateral, Y-axis, motion.

In operation, as the sewing machine advances Forward (toward the fabric supply rollers), the Forward take-up roller position sensor, $S_F$, that is, the sensor mounted on the sewing machine near the back of the throat, contacts the take-up roller, triggers the take-up roller carriage motor(s), causing the roller to take up more cloth so that the vertical body of the sewing machine supporting the sewing machine arm (the back of the throat) does not contact the take-up roller. Thus, the sewing machine head (on which the needle is mounted) can sew the full distance forward to the fabric supply roller. The tension system pulls the take-up roller Backwards (toward the quilter), so that as it "follows" the fore/aft (Forward/Backward) motion of the needle within the throat of the sewing machine, constant tension is maintained on the fabric layers and batting so the work area fabric is taut, as required for proper sewing.

Conversely, as the sewing machine is brought backward toward the take-up roller, the Backward sensor, $S_B$ (that is, the sensor mounted on the sewing machine adjacent the head carrying the reciprocating needle), detects the presence/position of the take-up roller (either by direct contact, contact with a sensor wire or other methods), and the take-up roller motor is triggered to reverse, thereby causing the take-up roller to unfurl (pay out) the quilted cloth under tension, again moving and increasing the varying work area (VSA). The take-up roller carriage motor advances or retracts the take-up roller, furling or unfurling the cloth while the tension system maintains the cloth under the necessary constant tension.

The result is an apparatus, system and method that produces a substantial constant and uniformly taut VSA that is independent of the throat depth of the particular sewing machine used, and independent of the carriage on which the sewing machine is mounted, be it: free hand X-Y carriages; computer controlled X-Y carriages; template and follower patterning systems (which also use X-Y carriages); for hobby, art, or professional quilt production.

This constantly moving Variable Sewing Area is greater than: 1) the Maximum Pattern Depth, MxPD (typically 12" deep); 2) the Throat Depth of the sewing machine (typically 6 –9" deep for home sewing machines); and 3) the prior art Effective Sewing Depth, which heretofore has been <MxPD and <TD. In the prior art, the ESD continuously is reduced as the Roll Size Increase grows due to the accumulation of completed sewing product on the take-up roller. That is no longer a limitation as a result of the inventive VSA system. Indeed, with the inventive VSA system, the VSA, and accordingly the MxPD, is only limited by the distance between the take-up roller at the Back and the closest fabric supply (payout) roller. Where those rollers are arranged farther apart on suitable end plates, and there is a corresponding lateral lengthening of the Y-carriage platform, it is possible to sew two or more rows of patterns in one Left to Right sweep, or to increase pattern depth size from 12' to 18" or more. Indeed, the inventive VSA system can be easily adapted by those skilled in the art to commercial sewing operations employing sewing machines with throat depths greater than available in home, seamstress, sewing shop and hobby type sewing machines.

In view of the foregoing, it is among the objects and advantages of the present invention to provide an affordable and user-friendly apparatus to allow the sewing of patterns larger than the throat depth of a sewing machine. It is also an object/advantage of the present invention to be usable with a wide variety of existing and future hobby and professional quilting frames. It is also an object/advantage of the present invention to be usable with a wide variety of existing and future hobby and professional sewing machines of a wide range of throat depths. It is also an object/advantage of the present invention to provide automatic, continuous operation whereby the take-up roller is moved automatically without user initiation to allow the sewing of patterns larger than the throat depth of a sewing machine. It is also an object/advantage of the present invention to provide a lightweight apparatus which is portable and can be used with portable quilting frames. It is also an object/advantage of the present invention to be usable with a wide variety of computer controlled, manually controlled (free hand), or X-Y template-guided sewing machine carriages provided by the manufacturers of hobby and professional quilting frame or by third parties.

Consistent with the foregoing objects, and in accordance with the present invention as embodied and broadly described herein, a method and apparatus are disclosed in the presently preferred embodiment of the present invention comprising a powered take-up roller journaled in one or more movable motorized carriage assemblies (and where only one motor is used on one end of the take-up roller, an opposed movable take-up roller idler carriage assembly); two opposed end plates having tracks or sliding surfaces mounted thereon receiving the roller carriage assemblies; a sensor system for initiating take-up roller rotation, an automatic tension system; control electronics for use with a quilting frame of any dimension; and a sewing machine of any throat depth.

In addition, the inventive VSA system can be integrated with quilting application software to provide PC operated quilting with automatic VSA. The apparatus and method provides automatic, powered fore and aft (Forward/Backward) lateral movement of the quilting frame's takeup roller while simultaneously rotating the take-up roller clockwise or counter-clockwise to allow take-up or payout (furling or unfurling) of fabric layers to provide a movable working area, called a Variable Sewing Area or VSA. The VSA permits increased lateral pattern coverage by means of conventional sewing machine carriages used with the quilting frame, while tension is simultaneously maintained on the fabric layers stretched between the take-up roller and the payout roller or rollers. The prior art restriction on pattern depth caused by the combination of a fixed takup roller and limited sewing machine throat depth is substantially reduced or eliminated.

In one presently preferred embodiment of the present invention, the take-up roller may be configured in sections or telescoping to provide a wide range of quilt widths. In the alternative, it may be of any desired fixed length. In any of these configurations, it may be square, round, elliptical or polygonal in cross-section. The take-up roller in any such configuration is attached at each end to a movable carriage assembly. In the optional embodiment where a motor is used only at one end, the other end of the take-up roller is mounted to a movable idler carriage assembly.

A tension device system is used at both take-up roller carriages to provide Backward tension on the movable motor and optional movable idler assembly carriages to maintain constant tension on the fabric layer or layers stretched between the fabric supply (payout) rollers of the quilting frame and the take-up roller. Tracks, rails or sliding surfaces may be used to facilitate the fore and aft lateral movement of the movable motor carriage assembly and the idler assembly at each end of the take-up roller, independent of both the motorized rotation of the take-up roller and of the tensioning device(s). The corresponding tracks, rails or sliding surfaces preferably are mounted on each opposed end plate of the apparatus and preferably include at least a Back stop, and optionally also a Forward Stop, to limit movement of the take-up roller beyond an appropriate working range. In the alternative, with simple reversal of parts, the tracks may be on the take-up roller motorized carriage and the idler carriage, and the wheels or other sliding members may be mounted on the end plates.

Continuing with a presently preferred embodiment, the movable motor carriage assembly comprises a direct current reversible motor connected to a gear box with a projecting shaft (available in the marketplace as a complete pre-assembled unit, commonly known as gear head motors). Wheels are attached to the gear head motor assembly unit in an operative geometric array using commonly available fasteners; the wheels are preferably grooved to receive the guide tracks or rails secured to the end plates. Each end of the take-up roller is attached to the respective Left or Right motor assembly output shaft, optionally but preferably by means of a coupling tube which fits over the gear box output shaft and is locked in place by means of a set screw, removable pin, or the like. The other end of the coupling tube slides into or over the tubular take-up roller and is locked in place by means of a set screw or a removable pin.

Conversely, an idler plate having similar wheels mounted thereto is provided for the opposite end plate in the embodiment where only one motor is used (not preferred). Similarly, the idler assembly end of the take-up roller is slid onto a roller mounting shaft provided on the carriage plate; the take-up roller is free to rotate on that shaft or that shaft itself rotates.

Continuing with a presently preferred embodiment, the movable carriage of the motor assemblies, or/and idler assembly, are each attached to a tension device which exerts a constant tension force on the take-up roller so as to hold taut the fabric and batting layers which are stretched between the payout rollers and the take-up roller. The tension device(s) preferably comprise weight(s) attached to cables for constant force tension, but may include or comprise any other constant force unit, such as counter wound springs, or elastic materials, springs, or the like, or automatic motor-driven tensioning system, or a combination thereof, for the constant tension.

Finally, in the presently preferred embodiment, the control electronics comprise a power supply, a microprocessor and sensors or contact switches which detect the position of the take-up roller relative to the sewing machine body and needle, to initiate rotary motor action to laterally move the take-up roller to avoid contact with the sewing needle or sewing machine body as either approach the take-up roller. In the preferred embodiment, the sensors comprise pendulum-type ring contact switches that are mounted on the sewing machine arm, one adjacent the Back of the throat and one at the Front.

Alternately, the sensors comprise reed or other type contact switches mounted on a Γ (gamma) shaped arm, having its base secured to the Y carriage. The long portion of the arm is oriented horizontally, rests on the take-up roller, and the sensors are mounted on it, one on each side of the take-up roller.

The sensors in both the preferred embodiment and in the alternate (arm and sensor wire) embodiments are mounted to straddle the take-up roller, the Forward motion sensor detecting an approach of the body of the sewing machine to the fabric supply roller and the Backward motion sensor detecting an approach of the needle to the take-up roller. Note that approach of the needle to the payout roller is the same as approach of the body of the sewing machine "throat" to the take-up roller, in that either causes the take-up roller to move out of the way. The sensors can be disposed on the sewing machine or on the sensor arm in any suitable orientation with respect to the payout and take-up rollers: straddling one roller, the presently preferred mode being to straddle the take-up roller. Alternately, the sensors could straddle more than one roller, or be disposed between both rollers, with suitable adjustment to the circuitry, which is well within the skill in the art.

Using a conventional quilting frame, an X-axis motor is mounted on the X-axis carriage, and using flexible, stranded wire cable (or the equivalent) and pulleys, the X-axis carriage is moved left and right along the length of the quilt frame (right/left direction) by energizing the X-axis motor in a clockwise or counterclockwise manner. A Y-axis motor is mounted on the X or Y carriage, and using the same cable/pulley system, the Y-axis carriage is moved in the front/back direction by energizing the Y-axis motor in a clockwise or counter-clockwise direction. The X/Y carriage motors are typically standard, commercially available servomotors. Standard, commercially available, position encoders, which are connected to the electronics which energizes the motors, are mounted on the X- and Y-axis motors or associated pulleys or carriages. The motors are connected to electronics that incorporates a feedback loop which reads the encoders to determine the position of the motors at all times. The electronics is connected to a standard PC using a parallel, serial, USB, or equivalent, cable. Software in the PC provides control functions, including at a minimum, reading pattern files and sending signals to initiate motor rotation for carriage motion and positioning, and turning on/off the sewing head to actually sew the patterns onto the fabric layers on the quilt frame.

The preferred PC Quilter X/Y carriage and applications program system varies from the above typical X-Y carriage system in that, using a conventional quilting frame, an X-axis motor and a Y-axis motor are both mounted on the X-axis carriage. The X-axis motor, using a timing pulley, walks the X-axis carriage a long a timing belt stretched under tension longitudinally on the quilt frame thus achieving right/left motion. The Y-axis motor, using a timing pulley and a length of timing belt fastened to the Y-axis carriage above the X-axis carriage, moves the Y-axis carriage in the front/back direction relative to the X-axis carriage upon which it moves. As before, the X-axis carriage moves on rails or tracks that are mounted longitudinally on the quilt frame, and the Y-axis carriage moves on rails or tracks mounted on the X-axis carriage. The motors are standard, commercially available stepper motors. Positional encoders are not required for normal operation, but may be used. The motors are connected to a microprocessor in the X-axis carriage and connected to a standard PC using a parallel, serial, USB, or equivalent cable. Quilting software loaded in the PC provides various selected functions, including at a minimum, reading pattern files, moving the motors to follow a pre-selected pattern and turning on/off the sewing head. The PC Quilter system is particularly suited for use with a home style sewing machine to sew any one of supplied patterns, patterns designed by the quilter or patterns provided by third parties, into the fabric layers on the quilt frame.

BRIEF DESCRIPTION OF THE DRAWINGS

The invention is described in more detail with reference to the drawings, in which:

FIGS. 2*a*–2*d* are a series of schematic side elevation views showing the comparative advantages of the inventive VSA motorized, laterally movable take-up roller system as compared to the prior art, in which FIGS. 2*a* and 2*b* show the prior art, FIG. 2*a* showing a sewing machine fully forward and FIG. 2*b* fully back, together illustrating the throat limitations of the sewing machine of FIG. 1 and how the throat depth ("T") shrinks by the accumulation of rolled up fabric layers and batting on the take-up roller inside the sewing machine throat, and FIGS. 2*c* and 2*d* show the inventive VSA system as creating a larger, moving work area permitting sewing full depth patterns and illustrates the preferred placement of the take-up roller sensors on the sewing machine;

FIGS. 10A through 10E are a logic flow chart of the method of operation of the inventive automatic, motorized, movable take-up roller system, as well as its communication with or optional integration into a quilting program and powered X/Y carriage apparatus systems.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

It will be readily understood that the components of the present invention, as generally described and illustrated in the Figures herein, could be arranged and designed in a wide variety of different configurations. Thus, the following, more detailed description of the embodiments and methods of the present invention, as represented in FIGS. 1 through 10E is not intended to limit the scope of the invention, as claimed, but is merely representative of the presently preferred embodiments of the invention. It should be noted that common parts numbers on the mirror image parts are identified with "a" or "b", and that whether left or right is not critical.

The present invention may take the form of a complete quilting frame assembly, or as a retrofit sub-assembly or an "accessory"-type improvement on typical commercially-available professional and hobby quilting frames, including hand-guided carriage assembly frame systems. For example, quilters already owning a powered PC-controlled X/Y carriage assembly can add the inventive VSA system with interface software.

Figure 1:
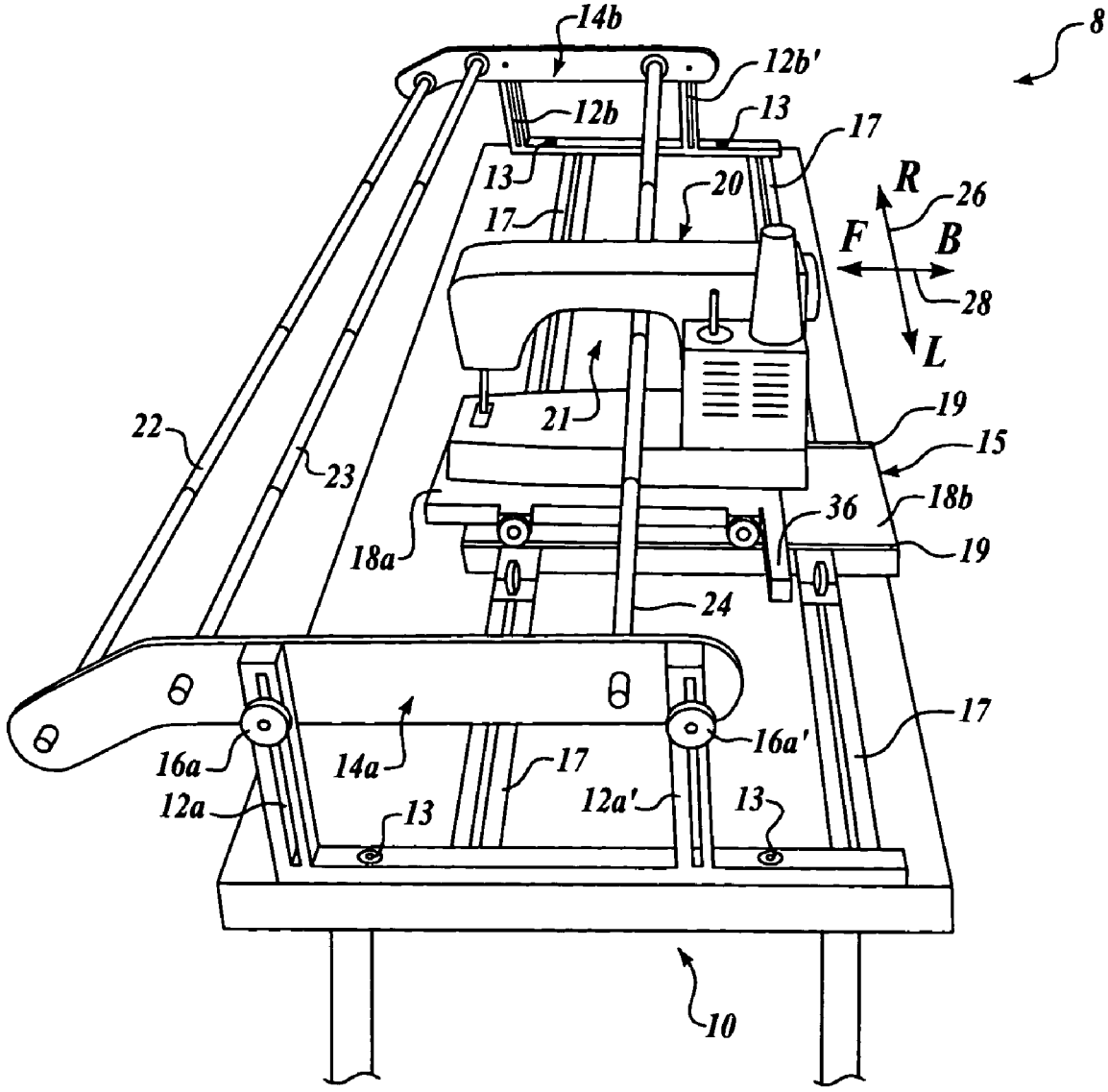
FIG. 1 shows an isometric view of an exemplary commercial quilting frame in association with a sewing machine mounted on X and Y carriages for either free hand, computer controlled, or template controlled pattern stitching which can be used in the inventive combination.

FIG. 1 depicts an exemplary known quilting frame 8 fastened to a table 10 (alternately, table 10 may be an integral part of the quilting frame). The quilting frame may be a kit-type, that is, of multiple parts mountable on any suitable table or other work surface 10. In the following detailed description, any motion (for example, of the sewing machine, sensor arm, or fabric) is described with reference to the perspective of the isometric view of FIG. 1, as defined herein.

Lateral movement 28 is defined as any motion along the Y axis, including motion of the sewing machine 20 to the front (F) or toward the back (B) of the person (not shown) engaged in quilting who would be standing at the location of arrows 26, 28. Longitudinal movement 26 is defined as any motion along the X axis, including motion of the sewing machine to the left and right of the person (not shown) engaged in quilting. Relative positions and movement along the lateral Y axis 28 are defined as follows: Forward/fore/front position/movement along the lateral Y axis 28 is any position or movement towards (closer to) the fabric and batting supply rollers 22, 23, the "F" end of the arrow; Backward/aft/rear position/movement along the lateral Y axis is any position or movement away from (further from) the fabric and batting supply rollers 22, 23, and towards (closer to) the take-up roller 24, the "B" end of the arrow. Relative positions and movement along the longitudinal X axis 26 are defined as follows: Left position/movement along the longitudinal X axis 26 is any position or movement towards (closer to) end plate 14*a* (the near end in the figure), the "L" end of the arrow; while Right position/movement along the longitudinal X axis 26 is any position or movement towards (closer to) end plate 14*b* (the far end in the figure), the "R" end of the arrow. Note, the Forward and Backward motion sensors 30*a*, 30*b* have a different frame of reference, as described above in the Summary.

The conventional quilting frame includes a left end plate 14*a* fastened by left side adjustment knobs 16*a*, 16*a*' to left side supports 12*a*, 12*a*' and a right end plate 14*b* fastened by right side adjustment knobs (not shown) to right side supports 12*b*, 12*b*'. The end plates 14*a* and 14*b* support one or more layers of fabric (see FIGS. 2*a, b*) rolled onto fabric and/or batting supply rollers 22, 23, and said layers of fabric are stretched between the supply rollers and the take-up roller 24. The rollers are of any suitable length. A layer of batting 25 (FIGS. 2*a, b*) optionally may be inserted between the fabric layers but such batting is not important to the invention or the following descriptions thereof, except as it does increase the size of the roll of material accumulated on the take-up roller, and thus causes rapid Roll Size Increase (RSI in FIG. 2*b*) which reduces the both the Effective Sewing Distance, ESD, and Maximum Pattern Distance, MxPD, as the quilting progresses.

In the conventional, prior art quilting frames, the distance between the fabric supply rollers 22, 23 and the take-up roller 24 is fixed and it is important to maintain the fabric layers under equal and constant tension between the rollers. Conventionally, this is done by means of ratchets or gear-and-pin stops at the ends of rollers 22, 23 and 24. The distance between these rollers for hobby-type quilting frames as supplied by manufacturers typically ranges from 12" to 18".

Some embodiments of the existing typical quilting frames do not have adjustment knobs 16*a* and 16*b* but instead end plates 14*a* and 14*b* are in a fixed rigid position as part of the support 12*a*, 12*b* and may be an integral part of an overall quilting frame 8 or table 10. In all configurations of existing typical professional and hobby quilting frames, there are always fabric supply (payout) rollers 22, 23 and take-up roller 24, and the rollers are in a fixed configuration with respect to each other when the quilting frame is in use.

The sewing machine 20 is mounted to an X-Y carriage assembly 15 that provides for movement of the sewing machine 20 along the X-26 (longitudinal) and Y-28 (lateral) axes. The carriage assembly 15 comprises an upper carriage 18*a* and a lower carriage 18*b*. The upper carriage 18*a* is slidably movable along lateral motion carriage assembly rails 19, thereby moving the sewing machine in a lateral direction along the Y axis 28. In the case of manual (freehand) carriage systems, the upper carriage 18*a* may be moved by use of a carriage handle 36. The lower carriage 18*b* is slidably movable along longitudinal motion carriage assembly rails 17, thereby moving the sewing machine in a longitudinal direction along the X axis 26. These X-Y carriages 18*a*, 18*b* may be moved manually for free-hand sewing, or by motors in both a lateral direction 28 and a longitudinal direction 26, as described in more detail below, particularly with reference to FIG. 2*e*. In another alternative, the X-Y carriage may be replaced by a single carriage employing ball-type casters that permit both X and Y motion.

Figure 2A:
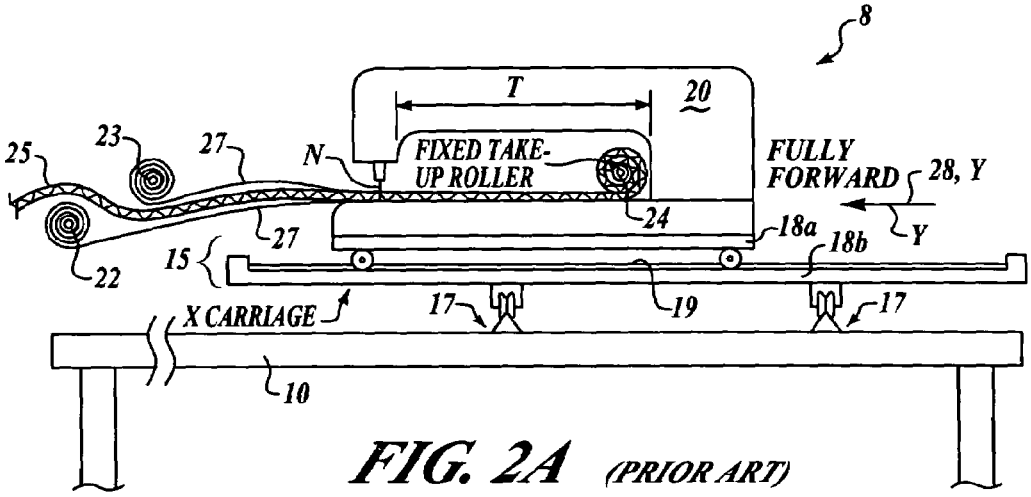
FIG. 2A (PRIOR ART)
Figure 2B:
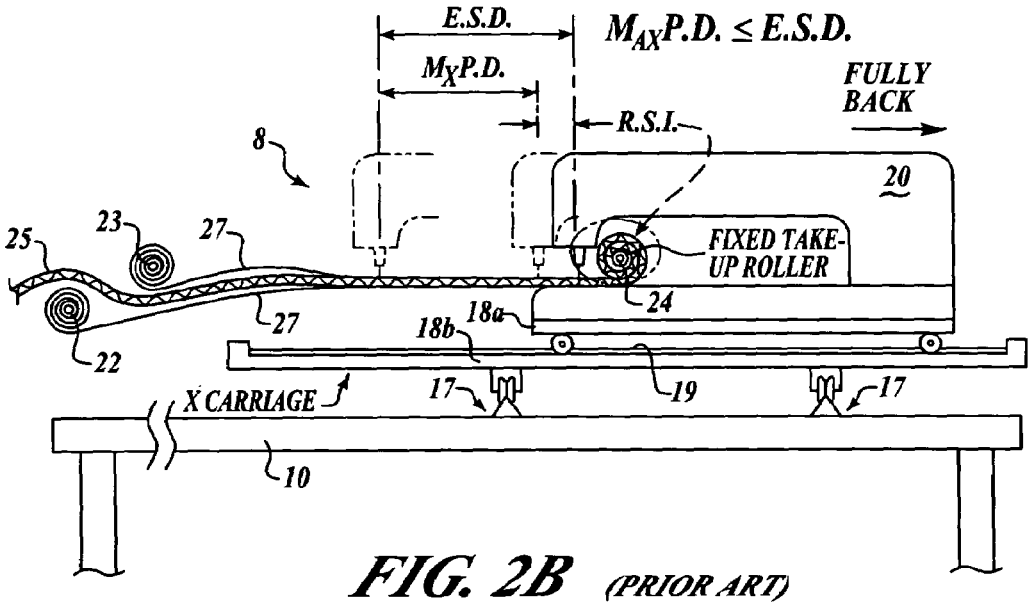
FIG. 2B (PRIOR ART)

FIGS. 2*a, b* depict the fixed relationship between the supply rollers 22, 23 and the take-up roller 24, the placement of batting 25 between fabric layers 27 on an exemplary quilting frame 8. Typically, fabric layers 27 are comprised of an upper layer of fabric and a lower layer of fabric and a layer of batting 25 between said layers. The quilting pattern is sewn through all three layers, although many variations of the aforementioned fabric layers 27 are common. The take-up roller 24 is positioned within the throat T of the sewing machine 20.

As shown in FIGS. 2*a, b*, in the conventional, currently available quilting frame systems, the Maximum Pattern Depth ("MxPD") is always less than the Throat Depth, T, and also less than the working area called the Effective Sewing Depth, "ESD", which is the distance between the sewing machine needle N and the fabric layers and batting wrapped around the take-up roller 24. The throat depth of the sewing machine (shown in FIG. 2*a* as "T") is the distance between the needle, N, of the sewing machine and the body-end of the sewing machine. When using a conventional quilting frame, the ESD will always be less than T because of the take-up roller 24 and fabric 27 rolled up on it, and in turn, T is typically smaller (less than) the pattern depth. For example, the throat depth of most home/hobby sewing machines is on the order of 6–9", while patterns range from 9" to 12" or more in depth. As a result, the quilt maker is forced to sew the quilt in strips that are less wide than the patterns, leading to repeat and mis-registration problems, or the quilter can only sew small (<6" depth) patterns.

As can be readily seen from FIGS. 2*a, b*, the lateral movement 28 of the sewing machine 20 is restricted to the size of the throat T because of the fixed nature of the take-up roller 24 being within the throat T of the sewing machine 20. Typically, the throat size as measured in the horizontal plane is 6 to 9 inches in a home or hobby sewing machine. Professional sewing machines may have as much as 30 inches of throat as measured in the horizontal plane.

Figure 2C:
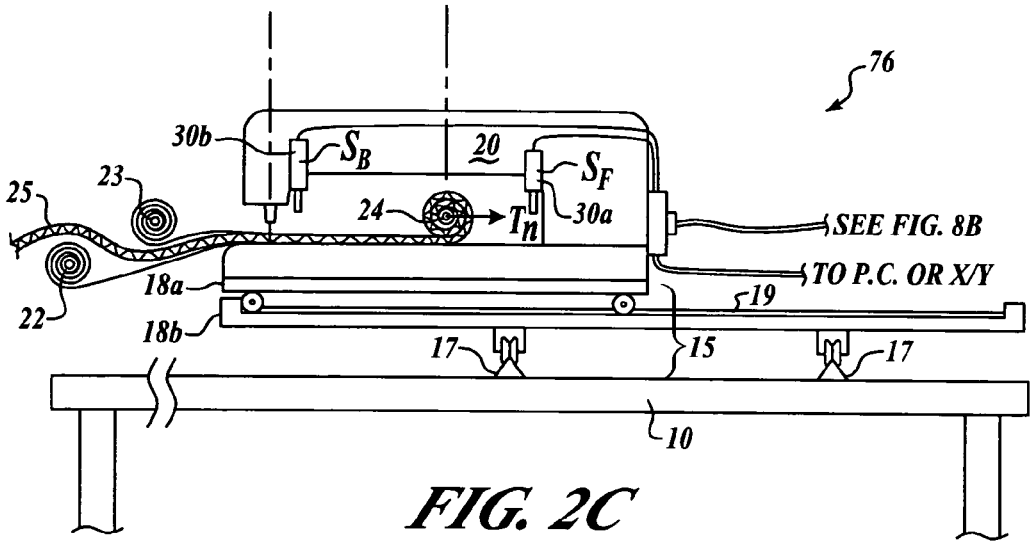
Figure 2D:
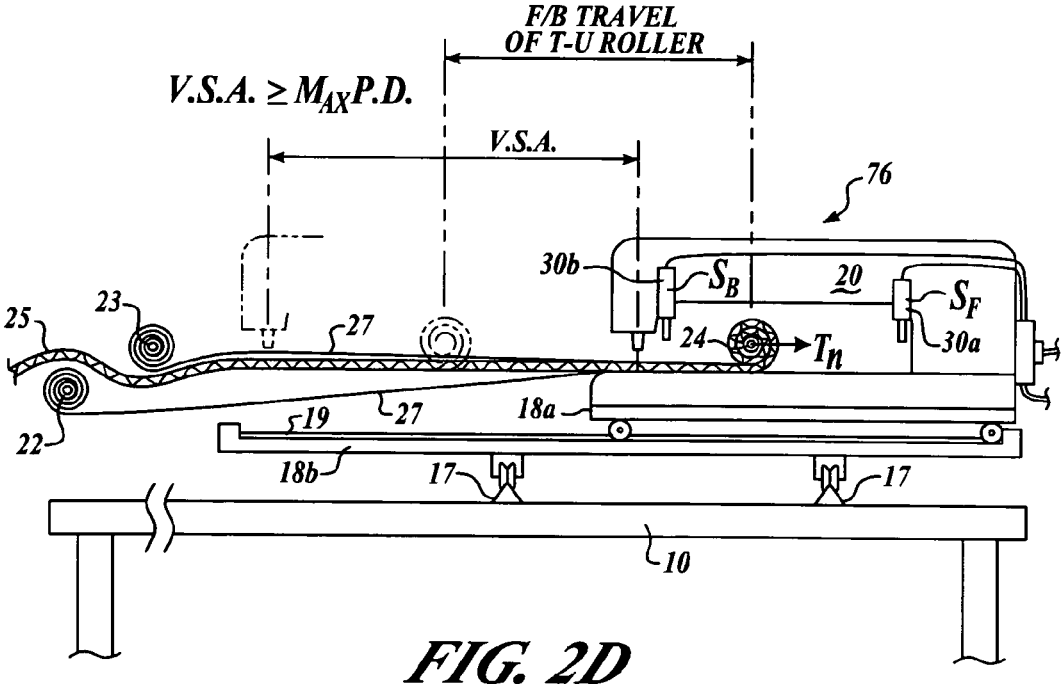

As can be seen from FIGS. 2*c* and 2*d*, with reference back to FIGS. 2*a* and 2*b* for comparison, the present invention provides a variable sewing area (VSA) that is greater than the MxPD (Maximum Pattern Depth). Indeed, the MxPD can be greatly enlarged, as the take-up roller to supply roller distance can be made greater, and due to the Forward/Backward movement of the take-up roller 24. As described in more detail below, when either the forward sensor $S_F$, 30*a* or the backward sensor $S_B$, 30*b*, contacts the completed fabric rolled-up on the take-up roller, the inventive powered take-up roller 24 is triggered to travel a distance that is controlled by the roller carriage controller, the parameters for which are set in the quilting program. The supply rollers also can be powered to rotate to pay out more fabric on demand (but need not move), an important alternative, but not the presently preferred embodiment. The constant tension on the roller is identified as Tn, and is always directed in the Backward direction.

Figure 2E:
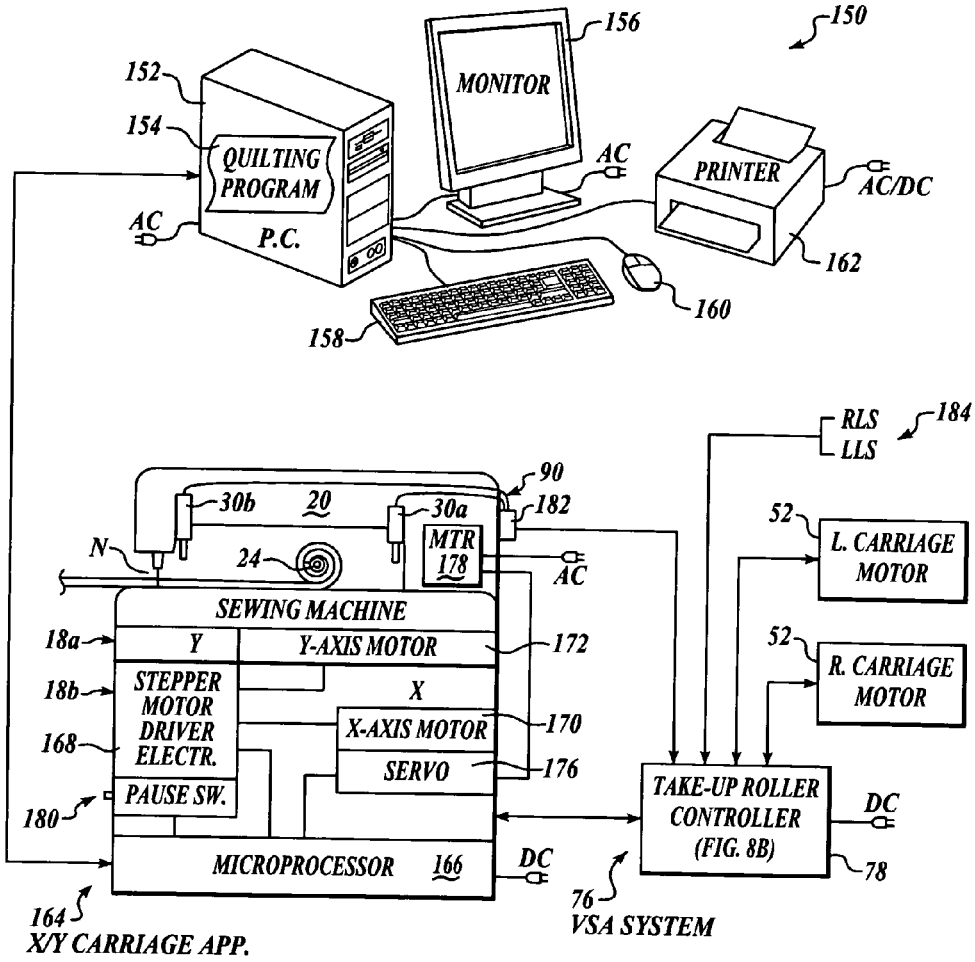
FIG. 2*e* is a schematic diagram of the overall architecture of the inventive VSA motorized, laterally movable take-up roller system integrated with a PC-controlled motorized X/Y carriage system.

FIG. 2*e* is a schematic of the integration of the inventive powered, automatic take-up roller VSA system with a quilting program. A Personal Computer system comprises a CPU having loaded thereon a quilting program 154 (for example of the PC Quilter brand type described above). The PC system is supported with a monitor 156, a keyboard 158, a mouse 160, and a printer 162. The quilting program drives both the X/Y carriage apparatus 164 and the VSA system 76. Control data from the quilting program is sent to the X/Y carriage microprocessor which in turn provides control signals to the stepper motor driver electronics 168. The driver 168 controls the X-axis motor 170 and the Y-axis motor 172 to position the sewing machine needle to follow the pattern read by the program from a digitally encoded pattern file stored in CPU memory. The microprocessor 166 also signals the sewing machine motor 178 to actuate the needle, N, to provide the appropriate stitch type, length and density for the user-selected pattern. A pause switch 180 is provided for the quilter operator to pause the operation as needed.

The microprocessor also passes motor parameters through to the take-up roller controller 78 of the VSA system for the Right and Left carriage motors 52, as described in more detail below and with particular reference to FIG. 8*b*. The forward and back sensors 30*a* and 30 b sense the approach of the take up roller and fabric 24, pass signals via junction box 182 to the take-up roller controller 78 which initiates the motor rotation/counter rotation and braking pulses to the motors 52 to cause the carriages to move the take-up roller 24 out of the way of the advancing needle or the back of the throat of the sewing machine 20, thereby providing the VSA. Magnet/sensor type limit switches 184 are provided on the end-plates to signal cut off of the carriage travel.

Figure 3A:
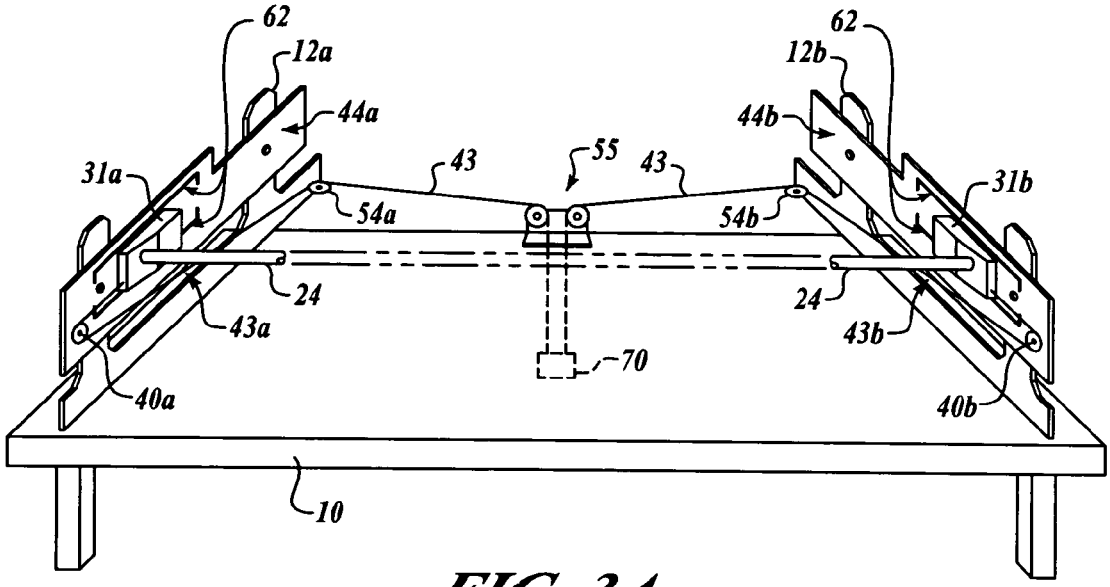
FIG. 3*a* is a schematic perspective view of a work table with a quilting frame to which the inventive motorized take-up roller has been mounted, and showing the cable and weight system for providing the back tension on the take up roller to insure the fabric is taut.

FIG. 3*a* is a perspective schematic view of the tensioning sub-assembly of the inventive VSA system. The inventive carriage end plates 44*a* and 44*b* are mounted on opposed, spaced side supports 12*a* and 12*b*, respectively. The respective carriage end plates 44*a*, 44*b* include tracks 62 on which are mounted the right and left motorized carriages 31*a*, 31*b*. The take-up roller 24 is journaled on the output gear shaft of the carriage motors.

Figure 3B:
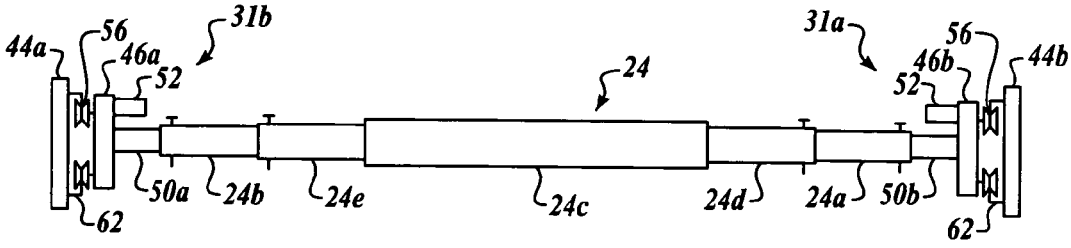
FIG. 3*b* is a front elevation schematic of the take up roller showing it journaled at each end on the carriage motor output shaft with intermediate connecting sleeves and tubing.

FIG. 3*b* shows in elevation, take-up roller assembly 24 journaled at each end on the motor output gear shafts 50*a*, 50*b* via sleeves 24*a*, 24*b* which fit over the powered carriage output shafts. The main take-up roller tubing 24*c* is connected to the sleeves 24*a*, 24*b* by square tubing 24*d*, 24*e* which prevents rotational slippage. The center tubing 24*c* can be any desired lengths, typically varying in 2–3' lengths from 2' to 12' long.

Figure 3C:
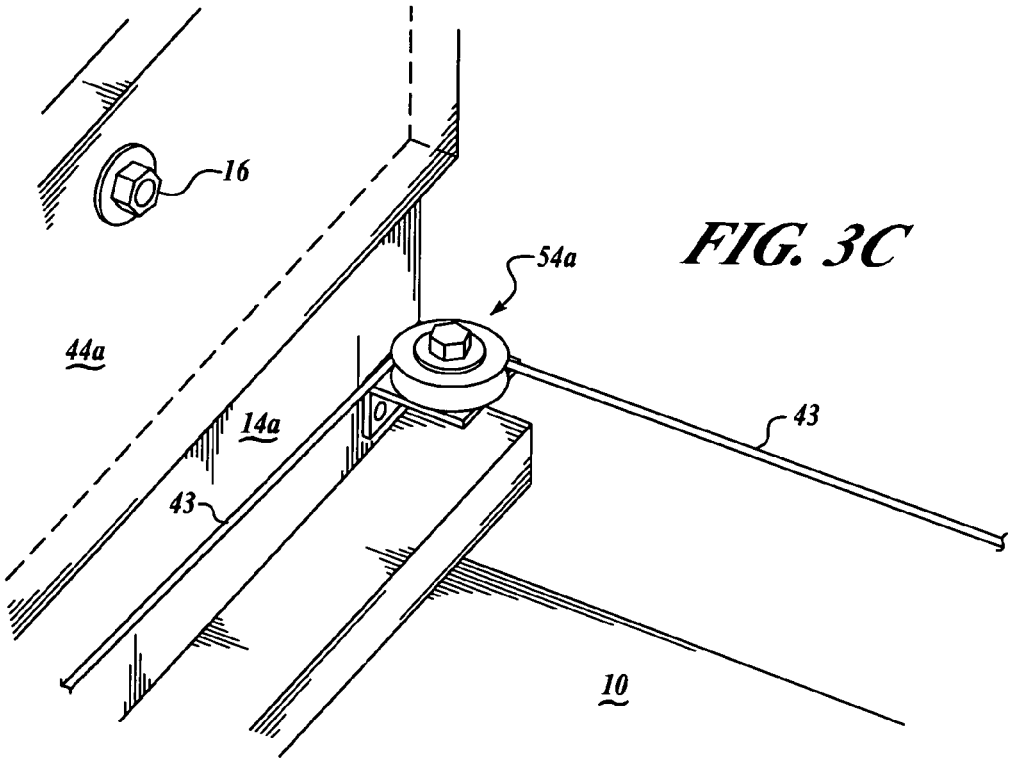
FIG. 3*c* shows an isometric view of a second embodiment of the inventive automatic, constant tension take-up roller apparatus, in which the sensing of the take-up roller position comprises a sensor arm mounted to the Y-axis carriage, a single motorized take-up carriage sub-assembly, an opposed idler end sub-assembly and tensioning system comprising separated weights (the sewing machine is not shown for clarity)
Figure 3D:
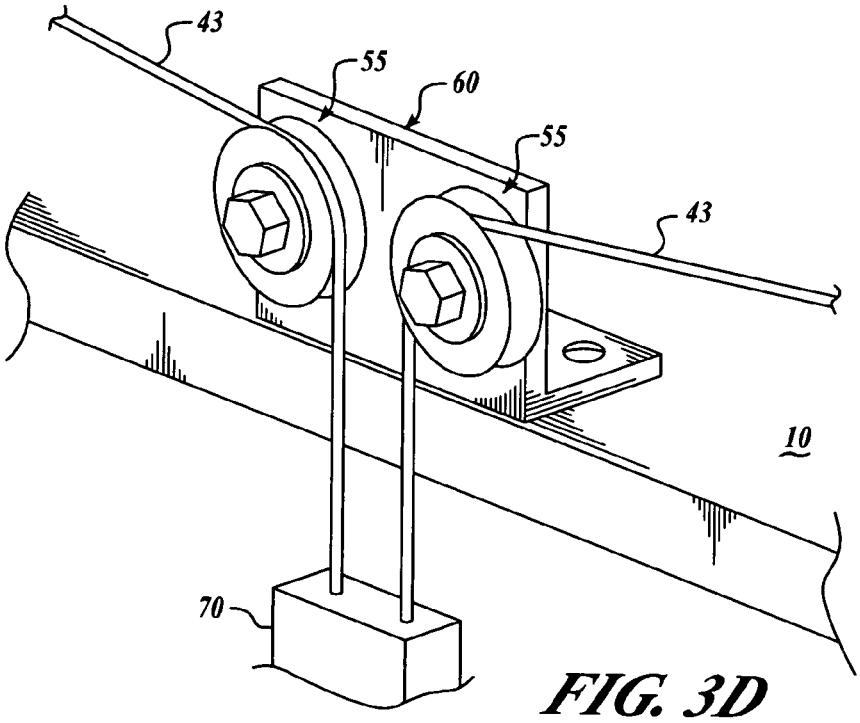
FIGS. 3*d* and 3*e* are perspective views of the cable and pulley guides for the tension system, FIG. 3*d* showing the forward guide on the end plate, and FIG. 3*d* showing the center guide to the weight.

As best shown in FIGS. 3*a*, 3*c*, 3*d* and 6, a tension cable 43*a*, 43*b* is tethered to each carriage and then passed around right and left rear tension guide pulleys 40*a*, 40*b*, respectively, and thence forward to the right and left forward tension guide pulleys 54*a*, 54*b*, respectively, as best seen in FIG. 3*c*. Finally, as best seen in FIG. 3*d*, the cable is turned transversely to meet at the center guide, comprising paired pulleys 55, mounted via a bracket 60 to the worktable 10, below which the cables are secured to common weight 70. This tensioning system puts equal tension on each take-up roller carriage, helping to prevent binding of the take-up roller due to skewing, and/or development of wrinkles in the fabric layers or sewed fabric overlaps.

Figure 3E:
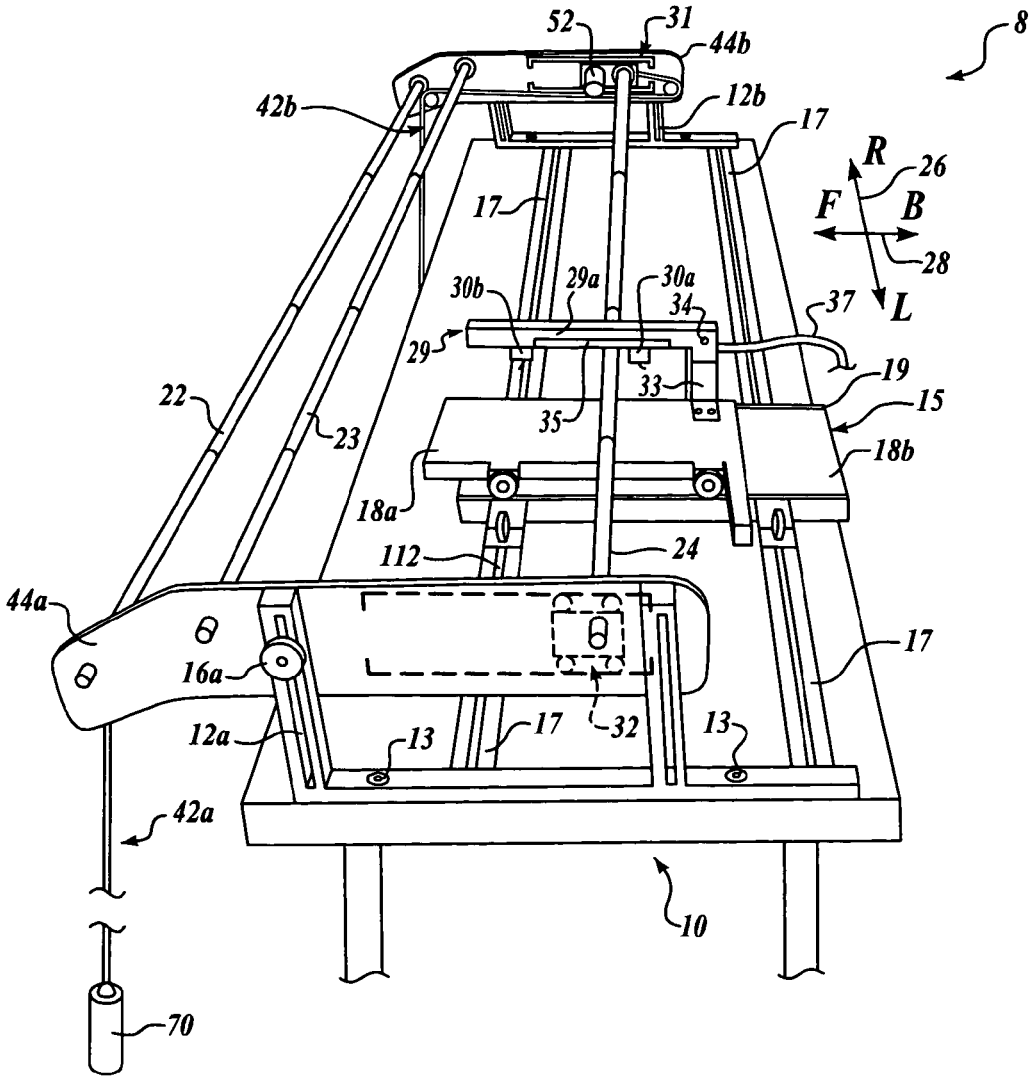
Figure 7:
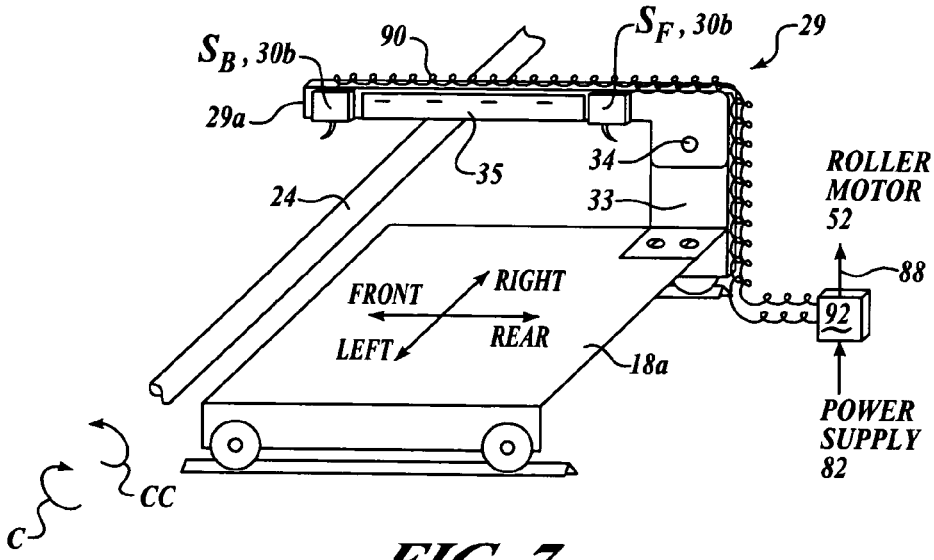
FIG. 7 is an isometric, schematic view of the alternate embodiment of take-up roller position sensing, comprising a sensor arm mounted to the Y-axis sewing machine carriage and showing wiring of the reed switch-type sensors to the take-up roller motor controller.

FIGS. 3*e* and 7 show an isometric view of an alternate embodiment of the inventive automatic, constant tension take-up roller apparatus, comprising sensors mounted on arm 29 carried by the Y-axis carriage 18*a* (which in turn is mounted on X-axis carriage that may be motor driven along timing tape 112), the sensors straddling the take-up roller 24, motor carriage sub-assembly 31, an opposed idler carriage sub-assembly 32 and a pair of separate, independent tensioning devices 42*a*, 42*b*.

Referring to FIGS. 3*e* and 7, the sensor arm assembly 29, comprises a sensor arm 29*a* connected to a sensor arm support bracket 33, mounted on an existing typical quilting frame Y-axis carriage 18*a*. Pivoting motion and height adjustment of the sensor arm 29*a* is allowed by a pin 34 and provides for varying thicknesses of take-up roller 24 and fabric layers 27 (not shown) rolled thereon. The sensor arm 29*a* rests and slides on take-up roller 24 and its associated rolled up fabric layers 27 in the direction of lateral motion 28 along with the sewing machine 20 (not shown) sitting or mounted on the Y-axis carriage 18*a*. A plastic guard 35, attached between the sensors to the underside of the sensor arm 29*a*, keeps the quilting fabric from snagging on the sensor arm 29*a* as it slides over the top of fabric (not shown) rolled on the take-up roller 24.

Referring to FIG. 3*e* (and FIG. 4), in this single motor-powered carriage embodiment, the inventive system comprises a motor carriage end plate 44*b* mounted on, adjacent to, or replaces, the right end plate 14*b* of a typical quilting frame, and an idler carriage end plate 44*a* mounted on, adjacent, or replaces, the left mounting plate 14*a* of a typical quilting frame. The motor carriage assembly 31 and the non-motorized idler carriage assembly 32 are connected by the take-up roller 24.

Figure 4:
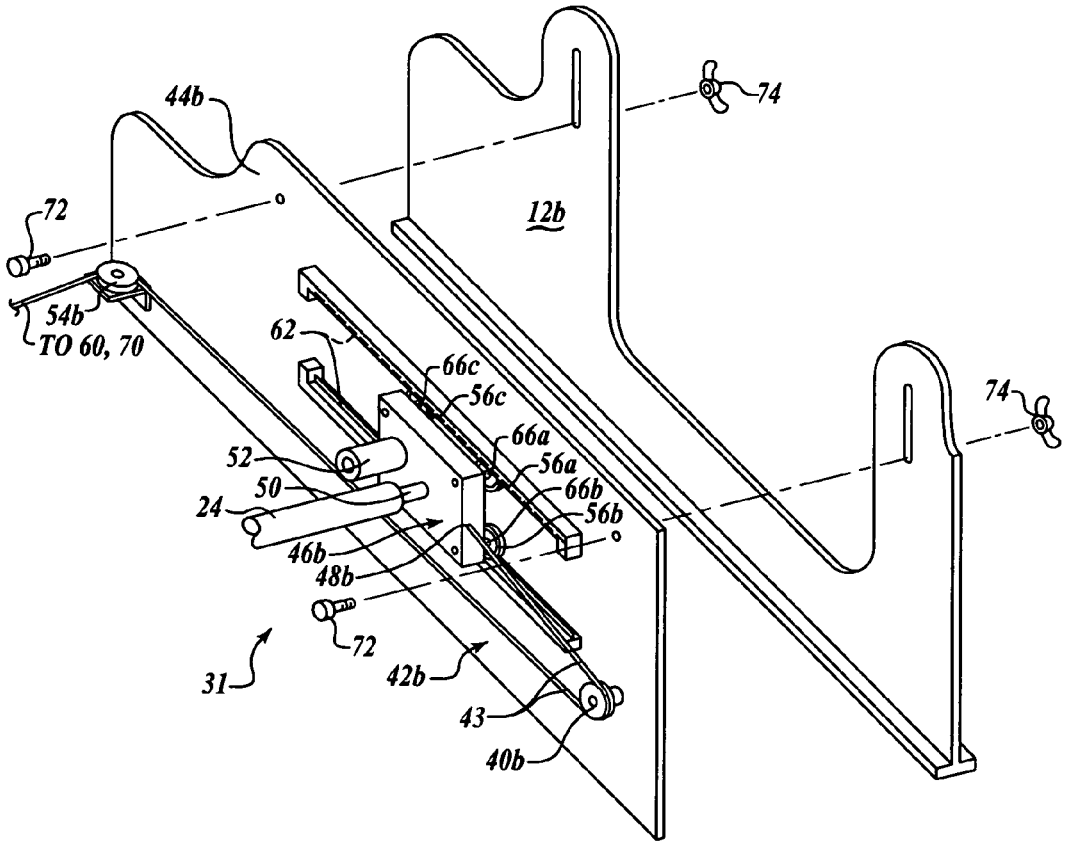
FIG. 4 shows a partially exploded, isometric view of the right side motorized, movable take-up roller carriage, end plate and support assemblies.
Figure 6:
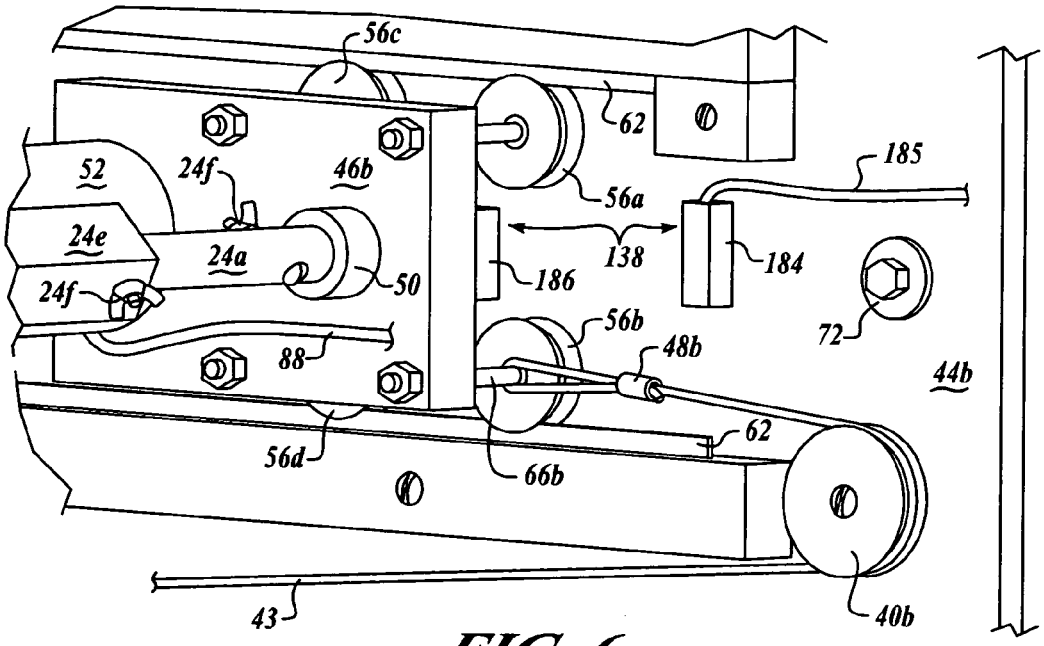
FIG. 6 is a perspective view of one of the motorized carriages for the take-up roller as mounted on the tracks and including limit sensors and the tension cable attachment with back side pulley guide.

FIG. 4 shows an exploded view of the motor carriage assembly 31, which can be used in either embodiment: the dual movable, powered carriages; or the movable, single powered carriage and idler carriage. The motorized carriage assembly 31 comprises a fixed carriage end plate 44*b* on which are mounted opposed, spaced carriage rails 62. The top rail 62 has opposed end stops and the bottom rail 62 may optionally (but need not) have a stop at its forward terminus, as shown. Grooved motor assembly wheels 56*a, b, c*, (*d* not shown) are attached by axles 66*a, b, c* (*d* not shown) to moving motorized carriage 46*b*, and these wheels engage with carriage rails 62 to allow for lateral motion 28 (shown in FIG. 1) of moving carriage 46*b* and corresponding lateral motion 28 of the take-up roller 24. A tension system 42*b* (comprising cable or line 43 and weight 70) is secured at 48*b* to the carriage 46*b*. Alternately, the cable 43 is looped around the shaft 66*b* and securely clamped to itself, as best seen in FIG. 6. The carriage tension cable 43 extends through the rear guide pulley 40*b* and wraps over and around a front guide pulley 54*b*, and thence it is turned orthogonal to the carriage end plate 44*b* to the center pulleys as best seen in FIGS. 3*a* and 3*b*. The tension system 42*b* provides tension on the movable carriage 46*b* in a backward direction (away from the fabric supply rollers 22, 23 and toward the take-up roller 24 as shown in FIG. 3*a*) at all times. This tension produces the necessary tension of the fabric layers 27 which are attached between the fabric supply rollers 22, 23 (not shown) and the take-up roller 24 for quality sewing.

Referring to FIG. 4, motor 52 is any device that can be actuated by a sensing device to rotate either clockwise or counter clockwise and transmit such rotational movement to take-up roller 24 either directly or indirectly. It is not necessary to drive the carriage wheels, as the rotational take up of fabric on the take-up roller 24 causes the carriage (and the take-up roller) to move Forward toward the fabric supply rollers 22, 23 as the sewing machine follows the pattern in the Y direction. Conversely, unrolling the fabric from the take-up roller causes the carriages to move Backward by virtue of the cable/pulley/weight(s) tension system 42*b*. The motor 52 and/or take-up roller carriage 46*a* may include gears, and the motor 52 is typically a reversible DC motor.

The motors 52 operate under a number of motor operating parameters which are supplied by the quilting program, or by a separate controller program of the inventive VSA system. For example, the motor 52 is controlled, by pulsing, to operate for limited periods of time following sensor contact with the take-up roller 24, to allow for incremental movement of the take-up roller 24. The motor preferably has multiple speeds. The power provided the motor is typically varied to compensate for increasing weight of material on the take-up roller. In addition, the motor is preferably controlled to use reverse braking, e.g., power-ON pulse for clockwise rotation, followed by shorter power pulse counter-clockwise, to brake. This prevents over-run, and provides controlled, defined incremental advance of the take-up roller out of the way of the advancing sewing machine throat back or the needle, as the case may be.

The take-up roller shaft 24 may be of any length: continuous (1 piece), segmented or telescoping; solid or hollow; made of any rigid material; and may have a cross-section of round, square, elliptical, polygonal or other similar shape. The automatic take-up/pay-out roller 24 is locked in place to an output shaft 50 using a sliding coupling and two locking pins (best seen in FIGS. 3*b* and 6). The fixed take-up roller 24 of a typical prior art quilting frame 8 (FIG. 1) is replaced with the automatic, powered, movable take-up/pay-out roller 24 of the present invention, or the opposed ends of a take-up roller of an existing typical quilting frame are adapted by the user to engage the output shafts 50 of the present invention.

One alternative embodiment of the present invention does not utilize a movable powered carriage assembly. Instead, the motor 52 is mounted on the fixed end plate 44*a* and the motor output shaft 50 is connected by means of a cable or similar device to a moving carriage plate or to a rotatable shaft or guide mounted on a carriage, or attached to or wrapped around the take-up roller 24. Such a moving carriage plate would be similar to the movable idler carriage plate 46*a* but connected to a motor fixed to the end plate 44*b* by a cable and configured to provide the same functions as the inventive movable, carriage with a cable-rotated output shaft to receive the take-up roller.

Figure 5:
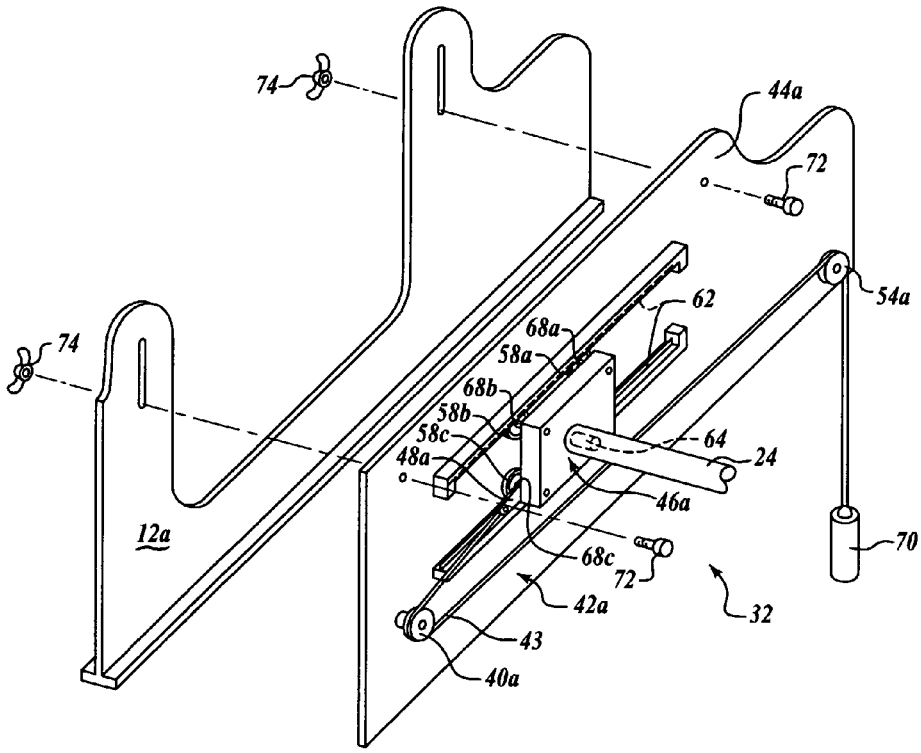
FIG. 5 shows a partially exploded, isometric view of an alternate embodiment of the automatic movable roller carriage system, in which one of the two movable take-up roller carriages comprises an idler carriage sub-assembly.

FIG. 5 shows an exploded view of the idler end assembly 32 for the non-preferred embodiment not employing power one of the two take-up roller carriages. The opposed end of the take-up roller 24 is slid onto an idler assembly connector shaft 64 and freely rotates as needed. Referring to FIG. 5, the idler end assembly 32 comprises a fixed idler carriage end plate 44*a* on which are mounted two opposed carriage rails 62. The top rail has opposed stops; the bottom rail optionally has a stop at its forward terminus. Grooved idler assembly wheels 58*a, b, c*, (*d* not shown) are attached by shafts 68*a, b, c* (*d* not shown) to moving idler carriage 46*b*, and the wheels engage the rails 62 to allow for lateral motion 28 (shown in FIG. 1) of the moving idler carriage 46*a* and corresponding lateral motion 28 of the take-up roller 24. The idler and motor carriage wheels may be of a lesser number than indicated in the currently preferred embodiment of the invention or may be replaced with sliding surfaces or ball bearing-type drawer slides.

An idler end tension device 42*a* (comprising cable 43, guides and weight 70) is connected by connector or crimped band 48*a* to the shaft 68*c* of the assembly wheel 58*c* of the moving idler carriage 46*a*. The idler carriage tension cable 43 extends through the left rear guide pulley 40*a* and wraps over and around a forward guide pulley 54*a* and down to weight 70. The idler carriage tension system 42*a* provides tension on the moving idler carriage 46*a* in the Backward direction at all times, providing tension to the fabric layers 27.

The idler carriage end plate 44*a* shown in FIG. 5 (and opposed motor carriage end plate 44*b* shown in FIG. 4) can be constructed of any rigid material such as wood, metal, or any type of rigid plastic, and are preferably vertically adjustable to compensate for differing heights of sewing machines and X/Y carriage systems. These end plates can be an integral part of an existing typical quilting frame 8 (shown in FIG. 1) upon which the inventive motor carriage assembly 31 and idler carriage assembly 32 are mounted.

Referring to FIGS. 4 and 5, the tension devices 42*a* and 42*b* comprise cable 43 attached to a weight 70, but may consist of any material which exerts tension such as a spring, elastic material, or a cable utilizing gravity to exert tension. The tension guides comprise pulleys 40*a*, 40*b*, and 54*a*, 54*b*, but may be any device which allows changing of the direction of the tension devices 42*a* and 42*b* so as to allow the tension system to physically fit on the end plates 44*a* and 44*b*, and to accommodate front or back weights. The tension guides are not necessary in some configurations. The weights are placed at the Forward end of the quilting frame (the left, L, in FIG. 1), or the sides of the table, so as to not interfere with the operator standing at the intersection of arrows 26 and 28. However, the weights can be suspended from the front (right, R, in FIG. 1) if desired. FIGS. 3*e* and 5 show a single weight per carriage hung in substantially the same plane as the end plate 44*a*. FIGS. 3*a*, 3*c*, 3*d* and 4 show a single, albeit heavier, weight suspended from two end cables brought together in the Forward center of the work table so the tension is balanced on both end carriages.

FIG. 6 is an isometric close up view of one powered carriage assembly 46*b* with its four grooved wheels 56*a*–56*d* mounted on the upper and lower rails 62, which in turn are mounted to the end plate 44*b*. The tension system cable 43 is shown secured around an axle 66*b*, crimped at 48*b*, and directed around the pulley 40*a* to the Front of the end plate. The body of the carriage 46*a* contains suitable reduction gears from motor 52 to the output shaft 50. The sleeve 24*a* fits over the end of output shaft 50 (not shown), and in turn fits into the square tubing 24*e*. They are pinned together with screws and wing nuts 24*f*. A limit switch system 138, comprising magnet 186 and magnetic field-activated sensor 184 are provided to cut off power to the motor 52 when the carriage position approaches the back end of the rails 62. Motor wiring 88 and sensor lead 185 are described in more detail in reference to FIGS. 2*e*, 8*a*, 8*b*, and 10*a*–10*e*.

Figure 8A:
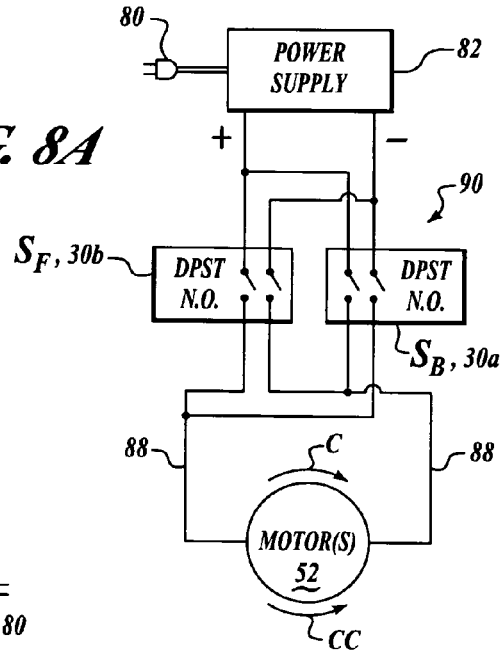
FIG. 8*a* is a schematic of exemplary, non-intelligent circuitry for the alternate sensor arm embodiment of FIGS. 3*c* and 7, and all other non-preferred embodiments, for actuating the automatic take-up roller motorized carriage.

FIG. 7 shows a partly schematic view of the alternate embodiment employing a sensor arm 29, in operation. The sensor arm comprises a support bracket 33 mounted on the Y-axis carriage 18*a*, and a pivot 34 connecting the sensor support 29*a* to the bracket 33. Wiring connects the sensor leads through a wiring box 92, and the movable take-up roller motor(s) 52 are powered through power supply 82. Suitable circuitry is shown in FIG. 8*a*. Referring to FIGS. 2*c*, 2*d*, 6, 7, 8*a* and 9*a*, as the sewing machine 20 or sensor arm 29 is moved in a forward direction, toward the Front, the Frontward motion rollup sensor, $S_F$, 30*a* (comprising in this embodiment two N.O., DPST sensor switches, best seen in FIG. 8*a*) contacts the take-up roller 24. This contact causes motor 52 to be energized and to rotate the take-up roller 24 in a counter-clockwise direction, arrow CC. This rotation, in conjunction with the tension system, cause the fabric of the sewing area to be wrapped around the take-up roller 24. Conversely, as the sensor arm 29 or sewing machine 20 is moved in a Backward direction, toward the Rear, the Backward motion unroll sensor, $S_B$, 30*a* (comprising two sensor switches best seen in FIG. 8*a*) contacts the take-up roller 24. The contact causes motor 52 to be energized and to rotate the take-up roller 24 in a clockwise direction, arrow C. This rotation, in conjunction with the tension system causes the fabric wrapped around the take-up roller 24 to unroll, still under tension. This description applies to the preferred sensor embodiment of FIGS. 2*c*, 2*d*, 2*e*, 9*b* and 9*c*, as well as to the arm-mounted switch sensors of FIG. 7 or the whisker sensors of FIG. 9*a*.

Figure 8B:
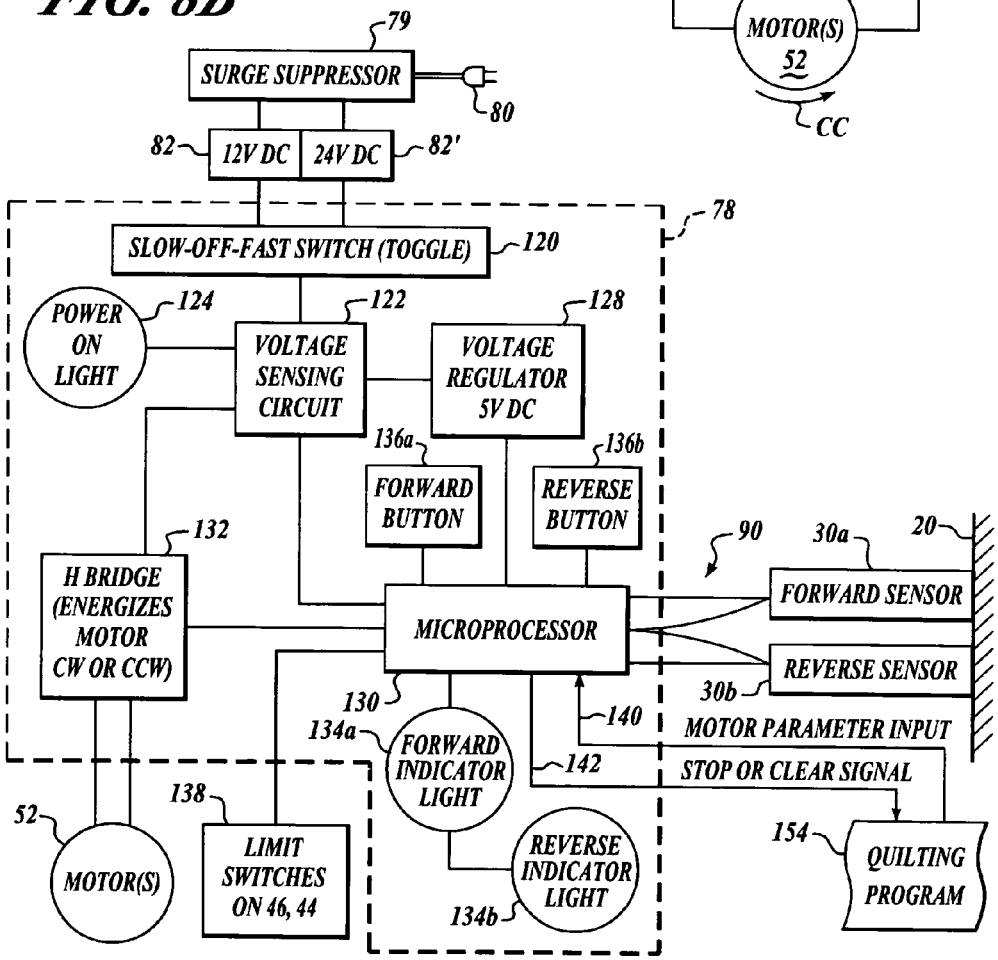
FIG. 8*b* is a schematic diagram of the current best mode preferred embodiment of circuitry for operation of the automatic, motorized take-up roller carriage employing sensors mounted on the sewing machine as in FIGS. 2*d* and 2*e;*
Figure 9A:
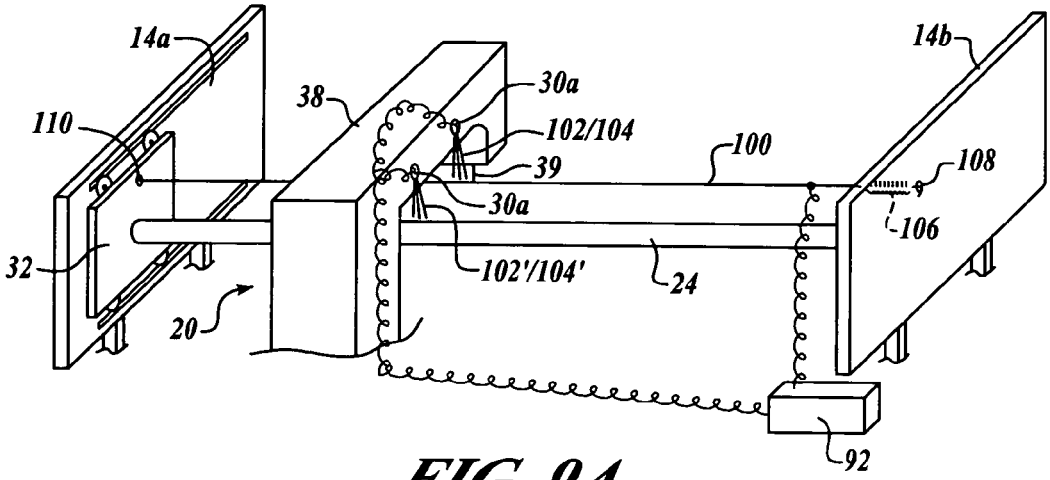
FIG. 9*a* shows a schematic view of a third embodiment of a take-up roller position sensor assembly comprising a sensor wire parallel to the take up roller triggered by whisker wires mounted to the body (horizontal arm) of the sewing machine.

It should be understood that while three variations of sensing switches are shown: the DPST switches of FIG. 7; the whisker sensors of FIG. 9*a*; and the pendulum-type ring contact sensors of FIGS. 2*d*, 2*e*, 9*c* and 9*d*, the sensing switches may be any device that can detect contact with, or proximity to, another object and transmit said detection to motor 52 or controller 78 (FIGS. 2*e* and 8*b*). The sensing devices may be mounted in any location on the existing typical quilting frame, the sewing machine 20 and/or on the X/Y carriage(s) of an existing typical quilting frame in any manner which allows the sensing devices to detect the need to energize motor 52 so as to move take-up roller 24 in a lateral direction of motion.

FIG. 8*a* shows a first embodiment of circuitry for the sensor arm to actuate the take-up roller. The circuitry may, but need not, contain "active" electronic components. As seen in FIG. 8*a*, there are no active components, and the circuit functions as follows: The DC transformer-rectifier power supply 82 is provided with standard 110 v. AC through a standard male wall plug 80 and supplies either 12 volts DC, or optionally 24 volts DC, to the motor 52 through two normally open DPST switches. The switches are called the Forward sense switch pair 30*a*, and the Backward sense switch pair 30*b*. When contact between the take-up roller (or fabric rolled up on the take up roller) occurs because of Forward lateral motion of the X-Y carriages, the Forward switch pair 30*a* is closed and turns on power to the motor in a polarity which causes counter clockwise rotation thereby allowing the take-up roller to move away from the sense switch pair, rolling up the fabric (as seen in FIGS. 2*c*, 2*e* and 7). When the rotational increment is sufficient to move the roller away from the switch, switch contact is broken and, the motor stops.

Conversely, when contact between the take-up roller (or fabric rolled up on the take-up roller) and Backward switch pair 30*b* occurs because of Backward lateral motion of the X-Y carriages, the Backward switch pair turns on power to the motor in a polarity which causes clockwise rotation (see FIGS. 2*d*, 2*e* and 7) thereby allowing the take-up roller to move Backwards, away from these sense switches and the sewing machine needle. With either switch pair, if contact continues, such as where backwards sewing matches the rate of unfurling, the motor continues incremental unfurling of the fabric. The overall effect of the circuit is to provide the quilter with a Variable Sewing Area.

FIG. 8*b* shows a second, best mode embodiment of "intelligent" circuitry architecture of the inventive VSA system control shown in FIG. 2*e*. The principal portion of the circuitry is housed within the controller unit 78. The system is powered with 110 v AC through a standard male plug 80 connected to a commercial surge suppressor 81. Two standard DC transformer-rectifiers 82, 82' are plugged into the surge suppressor each delivering 12 volts DC to the Slow-Off-Fast Switch 120 within the controller unit. When the toggle switch is in the OFF position, no voltage is available to the remaining circuitry. When in the Slow position, the switch delivers 12 volts DC to the remaining circuitry. When in the Fast position, the switch delivers 24 volts to the remaining circuitry. The Voltage Sensing Unit 128 detects the selected voltage delivered by the Slow-Off-Fast Switch, turns on the Power ON Light 124, and delivers the selected voltage to the Voltage Regulator 128. The voltage regulator reduces the voltage to 5 volts DC, holds it constant at that level, and delivers it to the microprocessor as its operational voltage. A standard H bridge subcircuit 132 controls the power to the motor and is controlled by the microprocessor. The microprocessor controls the H-bridge such that power in either polarity to the DC motor is turned on so as to cause counter-clockwise rotation, a clockwise rotation, or turned off.

The Microprocessor detects switch closures of the Forward sewing machine motion sensor switch 30*a* or the Backward motion sensor switch 30*b* and sets the H-bridge 132 to deliver the previously selected 12 or 24 volts DC to the Motors 52 with the appropriate polarity to cause the motor to run clockwise or counter-clockwise, as appropriate. The Microprocessor also turns on the Forward indicator light 134*a* or Reverse (Backward) indicator light 134*b* as appropriate. The Forward button 136*a* and Reverse button 136*b* are standard push switches in parallel with the Forward and Backward sensors, respectively, to enable the user to manually cause the motor to rotate clockwise or counter-clockwise. The microprocessor also detects input signals from the range limit switches 138 (FIGS. 2*e* and 6), and responds to such inputs by preventing power from being delivered to the motors. The carriage range limit sensors function as simple true/false switches and indicate proximity of the carriage to the Back end of its permitted travel.

The sensors can be electromechanical switches, electrodes which contact a sense wire or devices which use ultrasound, light, or magnetics to detect proximity. Programming of the microprocessor is within the standard techniques and abilities of those versed in the art. The microprocessor may also receive input from other external sources, such as motor control parameters 140 from quilting program 154 via the microprocessor 166, and output stop or clear condition signals 142 to the program. An exemplary program is PC Quilter, a software program that controls the X-Y carriage 164 of a quilter frame.

Exemplary pseudo-code for the VSA system controller microprocessor 130 is:

```
Check_Switch:
    get state of slow/off/fast switch
    if switch "off", go to Check_Switch
Check_for_Slow_or_Fast:
    if switch "slow", set motor_parameter_= slow
    if switch "fast",set motor_parameter_= fast
Check_Sense_Switches:
    if forward switch "on",goto Turn_Motor_Forward
    if reverse switch "on",goto Turn_Motor_Reverse
    if neither,goto Check_Switch
Turn_Motor_Forward:
    turn on "forward" LED
    turn motor counter clockwise by turning on transistors Q2 and Q3
    turn off motor by turning off transistors Q2 and Q3
    turn off"forwad" LED
    goto Check_Switch
Turn_Motor_Reverse:
    turn on "reverse" LED
    turn motor clockwise by turning on transistors Q1 and Q4
    pause for previously set motor runtime in milliseconds
    turn off motor by turning off transistors Q1 and Q4
    turn off"reverse" LED
    goto Check_Switch
```

The VSA microprocessor 130 continuously checks all inputs and initiates appropriate action. Its primary purpose is to turn on the motor(s) in the clockwise or counter clockwise direction based on either the forward or the reverse (Backward motion) sensor being activated for an appropriate duration. Other functions are turning on the appropriate indicator light, and using parameters to know how long to maintain motor power to the motor after a forward or reverse sensor is activated. The microprocessor can optionally activate or deactivate the motor slowly so as to cause a ramped up start or ramped down stop, both using standard pulse width modulation techniques. The X/Y carriage microprocessor 166 receives inputs from the program 154 initiating motor (X/Y carriages and sewing machine) functions in response to the selected program in the computer 150, including the pattern, stitch type and speed that the user has selected. In the integrated system, it can pass through the take-up roller motor parameters to the VSA microprocessor 130.

FIG. 9*a* shows a schematic view of a second, automatic take-up roller embodiment comprising a sensor wire 100 mounted horizontally to carriages 31*a*, 31*b* (shown in FIG. 3*a*) parallel to the take up roller 24, and passes through the sewing machine throat wherein the sensor wire 100 triggers, by contact, vertically-oriented whisker wires 102 mounted to the body of the sewing machine 20.

This alternative embodiment does not utilize a sensor arm assembly 29. Instead, the one or more whisker wires 102, 102' (front and rear) are attached to the horizontal arm 38 of the sewing machine 20 (and/or to an upper carriage 18*a*, not shown). The whisker wires 102, 102' are mounted to hang down within the throat area T (see FIG. 2*a*) of the sewing machine 20 and straddle the sensor wire 100. The sensor wire 100 is attached to the left carriage assembly 32 with a screw eye 110. The opposed end of the sensor wire 100 is attached to the right carriage assembly by use of a spring 106 and hook 108. The sensor wire may be a ground.

Electronics link contact by the sensor wire 100 with the whisker wires 102, 102' of sensors 104, 104' to power the corresponding rotation of the take-up roller 24. The motion of the fabric relative to the sewing machine needle and corresponding creation of a VSA is the same as disclosed above. Tension on fabric layers (not shown) is maintained by use of the disclosed tensioning system.

Broadly speaking, any follower system may be used so that the motion of the sewing machine 20 initiates the rotation and the lateral movement of take-up roller 24 forward and backward (potentially power assisted or not) in conjunction with a system for maintaining tension on fabric layers, such as any suitable counter-balance system exerting tension on the take-up roller 24 in a backward direction along the Y axis 28.

Figure 9B:
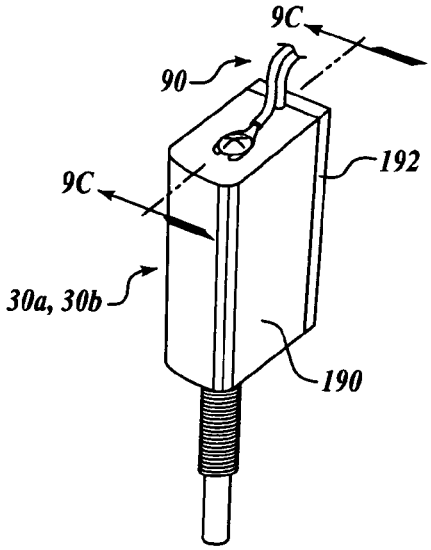
FIGS. 9*b* and 9*c* are, respectively, an isometric and a section view of the preferred, best mode pendulum-type sensor as employed secured to the sewing machine body for sensing the position of the take-up roller.
Figure 9C:
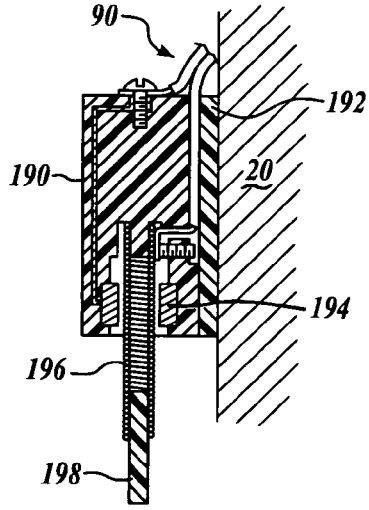

The currently preferred sensors are pendulum-type ring contact sensors shown in isometric and cross-section in FIGS. 9*b* and 9*c*. The sensor body is typically plastic and is secured to the sewing machine as shown in FIGS. 2*c*–2*e* and 8*b* by double sided tape 192. The sensor lead pair 90 separates in the sensor body so that one lead goes to a ring contact 194, and the other, via a set-screw to a spring 196. The spring, being suspended at one end, can provide a signal by contacting the ring in any horizontal direction. Where needed, a plastic extension rod 198 can be fitted into the lower end of the spring to extend its reach.

Figure 10A:
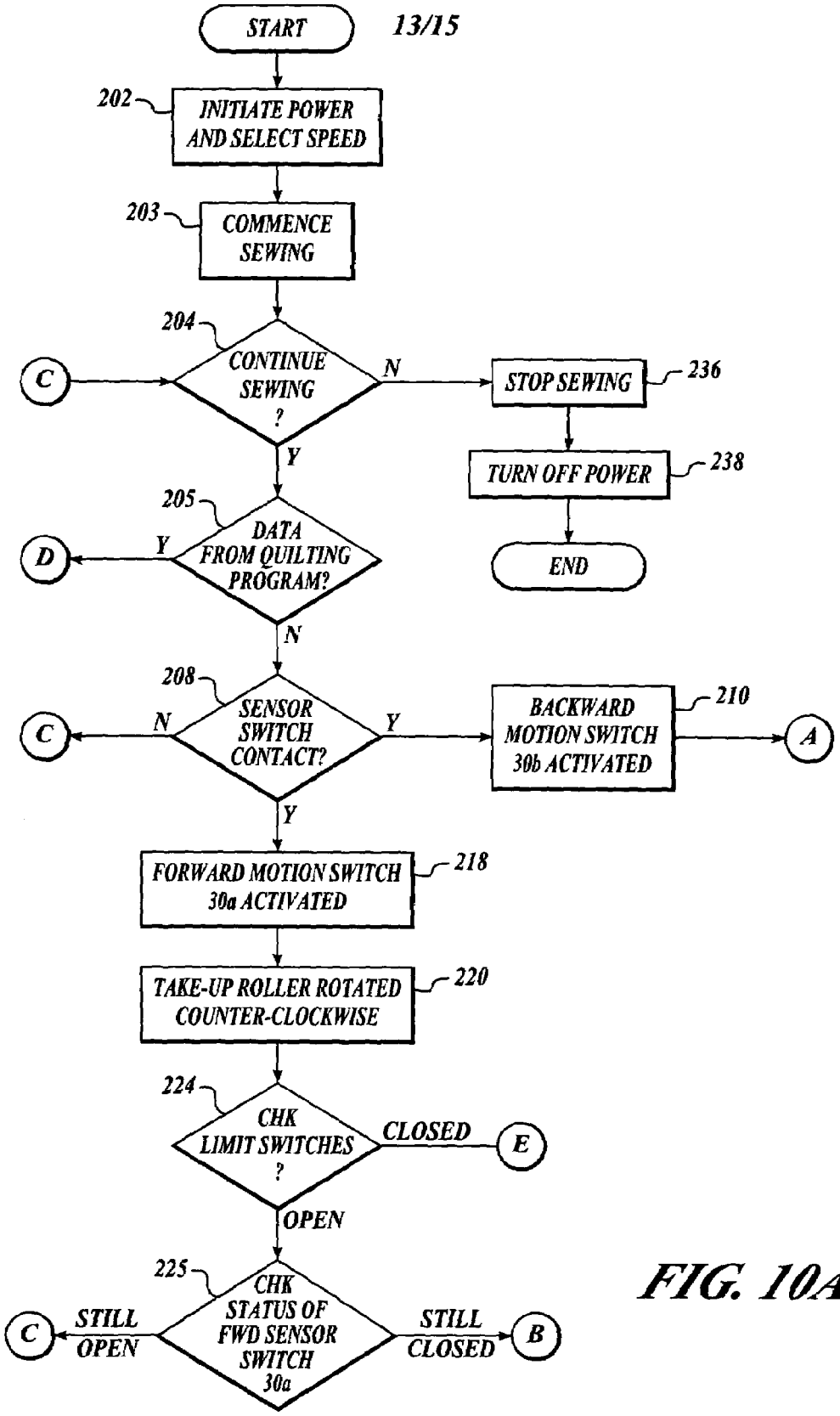

FIG. 10, comprising FIGS. 10A, 10B, 10C, 10D, and 10E, is a set of flow charts of quilter action and electronic take-up roller logic, as exemplified by the PC Quilter and VSA system of FIGS. 2*e* and 8*b*, above, showing the interaction of the two, and describing operation of the inventive system and method. The integrated system operation involves programmed control of motion of the sewing machine carriage in its X-Y plane and take-up roller carriage motion in the Y-axis (limited by limit switches 138 to prevent excess movement of the carriage in the Backward direction, FIG. 6). Manual switches 136*a* and 136*b* are used to recover from stoppage caused by a limit switch (FIG. 8*b*). The system operation primarily involves take-up and play-out of the quilt material by rotation of the take-up roller to create the Variable Sewing Area. Take-up roller rotation occurs when either the Forward or Backward motion sensor is closed.

FIG. 10A illustrates operation 200 of the VSA system with optional input/output from/to a quilting program. The operator (quilter) selects a pattern of the Quilting Program 154 (which includes the pertinent X/Y carriage, sewing machine and take-up roller carriages motors parameters, some of which may be default parameters), see FIGS. 2*e* and 8*b*. VSA system operation is initiated at 202 by the operator turning the Fast-Off-Slow switch (FIG. 8*b*, 120) from Off to Fast or Slow thereby selecting system power of 24 volts or 12 volts. The selected voltage determines operation in "fast" or "slow" mode. Sewing commences, 203. The VSA microprocessor (FIG. 8*b*, 130) commences its scanning routine, beginning at item C, to check various inputs and initiates appropriate action per the pseudo-code described with reference to FIG. 8*b*. Normally, sewing continues until the pattern/quilt is completed and sewing automatically stops 236. The operator turns off power 238 and the session ended.

However, if data is received from the Quilting Program, 205 the logic flow goes to point D diagrammed in FIG. 10D. The VSA microprocessor 130, FIG. 8*b*, receives only data 206 from the Quilting Program pertinent to its operation, such as take-up roller carriage motor control parameters, in which case it sets the new motor control parameters 207, and the logic loop returns to FIG. 10A at input point C (by 204).

As sewing continues and there is not data from the program, scanning for Forward and Backward motion Sensor Switch 30*a*, 30*b* contact 208 is continued. If no contact is detected, the logic loops back to point C input to 204. If the Forward motion Switch is Activated 218, the take up roller is rotated counter-clockwise 220 to move the take-up roller Forward, i.e. away from the quilter, see FIGS. 2*c* and 2*d*. Or if the Backward motion Switch 30*b* is activated 210, go to point A, flow to FIG. 10B) and the take-up roller is rotated clockwise 212. Sewing can continue after either of the Forward or Backward switches is activated, the effect being to maintain a Variable Sewing Area larger than the throat depth of the sewing machine.

Limit switches are checked at 214 FIG. 10B and 224 FIG. 10A. If a Limit Switch Closes 224, FIG. 10A or 10B, point E, we go to FIG. 10E, entry point E. The VSA microprocessor sends a "Stop" Signal to the Quilting Program 226, which Stops the X-Y Sewing Machine Carriage, 228, protecting the system from causing damage by exceeding its limits. The operator must Press the Forward or Reverse Button 229 to rotate the take up roller 230 until the Limit Switch 231 is again open and a "clear" signal is sent to the quilting program. The process flow loops to reenter FIG. 10A at point C, and sewing can resume. If for some reason the operator does not press the correct forward or reverse button, the operation loops to 231, and around, 226, 228 and 229 until the operator responds correctly. This process continues until the operator decides to stop sewing FIG. 10A 236 (stops the sewing machine from sewing) and turns off the power 238 (turns off the quilting program by exiting the program and turning off power to the X/Y carriage).

Returning to where we left off in FIG. 10B, the limit switches were being checked at 214. If open, the status of the rear sensor, 30*b* FIG. 2*c*, 2*d*, and if open, the process loops to C in FIG. 10A.

Likewise, looking at FIG. 10A, we left off at 224, checking the limit switch and considered the closed condition, reviewing FIG. 10E logic above. If open, we check the status of the Forward motion sensor switch 30*a*, 225. If open, we loop back to C in FIG. 10A, Returning then to the closed status of either the Backward motion sensor switch 30*b* at 216 in FIG. 10B, or the Forward motion sensor 30*a* at 225 in FIG. 10A, we go to the jammed sensor condition logic of FIG. 10C. The VSA controller sends a stop signal 226 to the quilting program, which in turn stops the sewing machine X/Y axis carriage motors. The operator is instructed to press the forward or reverse button, and the VSA controller checks for that condition 229. If one of the buttons is depressed, the carriage motor is actuated to rotate the take-up roller in the corresponding direction, until detection of the condition of the Forward or Backward sensor switch, 233. If not closed, a clear signal is sent to the quilting program 232, and the process can continue by looping to C in FIG. 10A. If it is still closed the process loops in FIG. 10C until the operator presses the correct button and the sensor is cleared.

INDUSTRIAL APPLICABILITY

It is clear that the inventive constant tension VSA system and method of this application has wide applicability to the quilting industry, and particularly to the hobby and art fields thereof. The system clearly permits full pattern depth sewing by conventional, small throat-depth home sewing machines. Thus, the inventive system expands the usefulness of small throat sewing machines by use of a simple, retrofit apparatus that is independent of the model and make of sewing machine and quilting frame. As such, it has the clear potential of becoming adopted as the new standard for apparatus and methods of quilting.

The powered, moving and rotating take-up roller apparatus described herein is a very substantial and novel improvement for both the professional and the hobby quilting frames. This invention is expected to greatly increase the popularity of using quilting frames especially by hobbyists and small businesses because of the relatively inexpensive nature of this apparatus and the simplicity of its use resulting from automatic operation. Such a quilting apparatus and methods for using the same substantially eliminate the above indicated disadvantages of the prior art professional and prior art hobby quilting frames.

It should be understood that various modifications within the scope of this invention can be made by one of ordinary skill in the art without departing from the spirit thereof and without undue experimentation. For example, by mounting fabric supply rollers 22, 23 to be rotationally powered by one or more motors, the pattern depth can be greatly enlarged; that is, larger patterns can be created, or the frame can be made more laterally compact. The two fabric supply rollers can be powered with a single motor that drives both rollers synchronously via a gear train to payout, or take-up fabric in a rotational direction opposite to the rotational action of the take-up roller 24. In addition, the sensors and motor actuation and control circuitry may be configured in a wide range of designs to provide the functionalities disclosed herein.

This invention is therefore to be defined by the scope of the appended claims as broadly as the prior art will permit, and in view of the specification if need be, including a full range of current and future equivalents thereof.

PARTS LIST To Assist Examination; May be Canceled upon Allowance at Option of Examiner.

8 exemplary quilting frame
9
10 table supporting exemplary quilting frame
12a/12a' left end plate support
12b/12b' right end plate support -continued 13 connecting bolt
14a right mounting support
14b left mounting support
15 carriage assembly
16a/16a' left side height adjustment knob
16b/16b' right side height adjustment knob
17 longitudinal motion carriage assembly rail
18a upper carriage assembly
18b lower carriage assembly
19 lateral motion carriage assembly rail
20 sewing machine
21 throat of sewing machine
22 front payout roller - top fabric layer
23 rear payout roller - bottom fabric layer
24 take-up roller; 24a, b sleeve; 24c main take-up roller tube; 24d, e square tubing; 24f pins (screws/wing nuts)
25 batting material
26 longitudinal motion along x axis
27 fabric layers
28 lateral motion along y axis
29 sensor arm assembly
29a sensor arm
30a front (distal/retraction) sensor switch pair
30b rear (medial/rollup) sensor switch pair
31a, b Left, Right carriage assembly
32 idler carriage assembly
33 sensor arm support bracket
34 pivot permitting angular adjustment of sensor arm
35 plastic guard
36 carriage handle
37 sensor leads
38 horizontal sewing machine arm
39 sewing machine head with needle
40a Right rear tension pulley
40b Left rear tension pulley
42a Right tension system
42b Left tension system
43 tension system cable - line
44a motor carriage end plate - right side
44b idler carriage end plate - left side
46a moving, rotating motor carriage assembly Right
46b optional moving, rotating non motorized idler assembly
48a motor carriage tension cable attachment point
48b idler carriage tension cable attachment point
50 output gear shafts
52a, 52b, motor(s) for take-up roller carriage
54a Front right tension pulley
54b Front left tension pulley
55 Center tension pulley pair (bogie)
56 a, b, c movable motor assembly wheels (56d not shown)
58 a, b, c movable idler assembly wheels (58d not shown)
60 Center tension pulley bracket
62 carriage rails
64 idler assembly connector shaft
66a, b, c motor assembly wheel shafts/axles (66d not shown)
68a, b, c idler assembly wheel shafts/axles (68d not shown)
70 weight(s)
72 smooth headed bolt
74 wing nut bolt
76 The Inventive VSA System
78 VSA System Controller unit
80 power plug
81 Surge suppressor
82 power supply (transformer)
84 medial (rear) sensor switch
84' medial (rear) sensor switch
86 distal (front) sensor switch
86' distal (front) sensor switch
88 motor wiring
90 switch wiring
92 wiring box
100 sensor wire
102 front whisker wires
102' rear whisker wires
104 front whisker wire sensor
104' rear whisker wire sensor
106 spring
108 hook
110 screw eye -continued 120–142 below, sorry
120 Slow-Off-Fast switch
122 Voltage sensing unit
124 Power-ON light
126
128 Voltage Regulator
130 VSA Microprocessor
132 H-Bridge
134 a and b Forward and Reverse indicator lights
136a, b Forward and Reverse buttons
138 limit switch system (see 184–186)
140 Motor parameter inputs
142 Stop - Clear signals
150 PC System
152 CPU
154 Quilting Program
156 Monitor
158 Keyboard
160 Mouse
162 Printer
164 X/Y Carriage apparatus
166 Microprocessor
168 Stepper Motor Driver electronics
170 X axis motor
172 Y axis motor
176 Servo
178 Sewing motor of sewing machine
180 Pause Switch
182 Junction box
184 Right and left limit switches
185 lead
186 Magnets
190–198 See Right Column, below
190 Plastic body of pendulum switch
192 double-sided tape
194 Ring contact
196 Spring contact
198 Extension Rod
200 Logic: Take-up roller control system
202 Logic-Pattern, power, speed selected (can be in program)
203 Logic: Operator commences sewing
204 Continue Sewing
205 Logic Decision Point: Data from quilting point yes-no
206 Receive data from quilting program 154
207 Change Take-Up Roller motor parameters
208 Logic: Sensor switch contact
210 Logic: Rear switch 30 b activated
212 Logic: Take-up roller rotated counter-clockwise
214 Check limit switches 216 check status of rear sensor sw
218 Logic: Front switch 30a activated
220 Logic: take-up roller rotated counter clockwise
224 Logic Decision Point: Check limit switches Closed/Open
225 Logic decision: Chk status of front sensor switch 30a
226 Logic: Send "Stop" to quilting program
228 Logic: Quilting program stops X-Y carriage
229 Logic Decision Point: Forward/Reverse button closed
230 Logic: Rotate take up roller 231 Lim Sw still closed?
232 Logic: Send "Clear" signal to Quilting program
233 Logic decision: Sensor switch still closed?
236 stop sewing
238 turn off power

The invention claimed is:

1. A quilting apparatus providing an automatic variable sewing area greater than a fixed throat depth of a sewing machine, comprising in operative combination:

a) a quilting frame including two opposed, longitudinally spaced end plates;

b) at least one fabric payout roller and a rotatable take-up roller defining therebetween a sewing area;

c) each said payout roller is mounted at its ends adjacent a forward end of said end plates to selectively pay out fabric to said sewing area;

d) a laterally movable carriage mounted to each of said end plates, said carriage including an output shaft for rotating said take-up roller; and said take-up roller is mounted at each end to said output shafts for rotation and for lateral movement;

e) a motor coupled to at least one of said output shafts to provided powered furling and unfurling of sewn fabric onto and off of said take-up roller;

f) a take-up roller approach sensor system mounted in association with said take-up roller for actuating powered automatic rotation of said take-up roller in one rotational direction that moves said take-up roller laterally forward upon furling of fabric onto said take-up roller to move said take-up roller so that it does not interfere with forward motion of a sewing machine, and powered automatic rotation of said take-up roller in an opposite rotational direction that moves said take-up roller laterally backward upon unfurling of fabric rolled up onto said take-up roller so that it does not interfere with backward motion of a sewing machine;

g) a tensioning system mounted in association with said carriage to maintain constant tension on the fabric in said sewing area as fabric is sewn; and h) said apparatus cooperatingly automatically maintains a variable sewing area that exceeds the fixed throat depth of the sewing machine.

2. A quilting apparatus as in claim 1 which includes an X/Y axis motion carriage system for a sewing machine, said X/Y carriage being mountable for longitudinal and lateral pattern movement between said end plates.

3. A quilting apparatus as in claim 1 wherein said take-up roller approach sensor system includes a plurality of take-up roller contact sensors mountable on a sewing machine, said sensors including a forward motion sensor mounted adjacent the back of the throat of said sewing machine, and a backward motion sensor mounted adjacent the needle head of said sewing machine.

4. A quilting apparatus as in claim 3 which includes at least one limit sensor mounted on at least one end plate to detect the backward limit of motion of said carriage, said sensor providing a motor cut off signal to prevent over-travel of said carriage on said end plate.

5. A quilting apparatus as in claim 1 which includes a take-up motion controller to receive input from said take-up roller sensor system and provide appropriate power to said motor to rotate said take-up roller to furl onto, or unfurl fabric from, said take-up roller so that said take-up roller moves away from an approaching throat back or needle head of a sewing machine, to maintain said variable sewing area substantially constant.

6. A quilting apparatus as in claim 1 wherein said tension system comprises a weighted cable attached to each said carriage and at least one guide for said cable.

7. A quilting apparatus as in claim 2 wherein said X/Y axis motion carriage system is powered and includes a controller for driving said carriages to follow a preselected pattern.

8. A quilting apparatus as in claim 7 which includes a quilting program loadable as an application program on a PC for controlling said X/Y axis pattern motion.

9. A quilting apparatus as in claim 8 which includes a take-up roller motion controller to receive input from said take-up roller sensor system and provide appropriate power to said motor to rotate said take-up roller to furl onto, or unfurl fabric from, said take-up roller so that said take-up roller moves away from an approaching throat back or needle head of a sewing machine, to maintain said variable sewing area substantially constant.

10. A quilting apparatus as in claim 9 wherein said quilting program includes parameters for controlling said take-up roller motor via said take-up roller controller.

11. A quilting apparatus as in claim 2 wherein said take-up roller sensor system includes a sensor arm pivotally mounted to a sensor arm bracket, said sensor arm bracket mounted to the Y-axis carriage of said X/Y carriage system, said sensor arm oriented in a lateral direction, generally orthogonal to and above said take-up roller, backward motion and forward motion contact switches mounted on the sensor arm in a laterally spaced relationship to straddle said take-up roller, and said switches are wired in circuit to said motor to activate motor driven clockwise or counter-clockwise rotation of the take-up roller upon contact of the respective backward motion sensor or forward motion sensor with the take-up roller.

12. A quilting apparatus as in claim 1 wherein the take-up roller sensor system comprises a sensor wire mounted between said end plates to pass longitudinally through the throat of a sewing machine, and at least one backward motion and at least one forward motion sensor mounted in association with a sewing machine or a Y-axis motion carriage for a sewing machine, and said sensor system is wired in a circuit to said motor to activate clockwise or counter-clockwise rotation of the take-up roller upon contact of a sensor with the sensor wire.

13. A method for automatically creating and maintaining in a quilting apparatus a variable sewing area greater than a fixed throat depth of a sewing machine during sewing of fabric mounted between at least one payout roller and a take-up roller, comprising the steps of:

a. providing a quilting frame including: two opposed, longitudinally spaced end plates; at least one fabric payout roller and a rotatable take-up roller laterally spaced from said payout roller to define therebetween a sewing area; each said payout roller is mounted at its ends adjacent a forward end of said end plates to selectively pay out fabric to said sewing area; said take-up roller is mounted laterally spaced from said payout roller toward the opposite, back end of said end plates;

b. automatically powering the rotation of said take-up roller during sewing to either furl fabric onto, or unfurl fabric from, said take-up roller during sewing c. automatically moving said take-up roller laterally during sewing so that said take-up roller does not interfere with forward or backward motion of said sewing machine during pattern sewing; and d. maintaining constant tension on the fabric in said sewing area as fabric is sewn; thereby automatically creating and maintaining a variable sewing area that exceeds the fixed throat depth of the sewing machine.

14. A method as in claim 13 wherein said steps of automatically powering the rotation and movement of said take-up roller includes sensing the relative approach of said take-up roller to the sewing machine throat back and sewing head, and actuating, in response to sensed approach, the powering of automatic rotation of said take-up roller in one rotational direction that moves said take-up roller laterally forward upon furling of fabric onto said take-up roller to move said take-up roller so that it does not interfere with forward motion of a sewing machine, and the powering of automatic rotation of said take-up roller in an opposite rotational direction that moves said take-up roller laterally backward upon unfurling of fabric rolled up onto said take-up roller so that it does not interfere with backward motion of a sewing machine.

15. A method as in claim 14 which includes the steps of: providing an X/Y axis motion sewing machine carriage system, said X/Y carriage system being mounted for longitudinal and lateral pattern movement between said end plates; powering said X/Y axis motion carriage system; and controlling the motion of said X/Y carriage system to follow a preselected pattern.

16. A method as in claim 15 wherein the step of controlling said X/Y axis pattern motion includes providing a quilting program loadable as an application program having a data file for said X/Y axis pattern motion.

17. A method as in claim 15 wherein said quilting program includes an instruction set including parameters to automatically cause a take-up roller motion controller to receive input from said take-up roller sensor system and provide appropriate power to said motor to rotate said take-up roller to furl onto, or unfurl fabric from, said take-up roller so that said take-up roller moves away from an approaching throat back or needle head of a sewing machine, to maintain said variable sewing area substantially constant.

18. A signal-bearing medium tangibly embodying a program of machine-readable instructions executable by a digital processing apparatus to perform operations on a quilting system having a rotatable and laterally movable take-up roller to maintain a variable working area greater than a fixed throat depth of a sewing machine.

19. A program as in claim 18 wherein said instructions include evaluation of take-up roller contact sensor signal data input and output of signals controlling the energizing of a motor powering the rotation of said take-up roller.

20. A program as in claim 18 wherein said instruction include signal output representative of a quilting pattern to drive motors of a powered X/Y axis sewing machine carriage.

* * * * *